US007261582B2

(12) United States Patent
Wu

(10) Patent No.: US 7,261,582 B2
(45) Date of Patent: Aug. 28, 2007

(54) CABLE CONNECTOR ASSEMBLY WITH INTERNAL PRINTED CIRCUIT BOARD

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/268,951

(22) Filed: Nov. 7, 2005

(65) Prior Publication Data

US 2007/0105410 A1 May 10, 2007

(51) Int. Cl.
*H01R 13/627* (2006.01)

(52) U.S. Cl. ..... 439/352

(58) Field of Classification Search ..... 439/350–358, 439/76, 499
See application file for complete search history.

(56) References Cited

U.S. PATENT DOCUMENTS 5,764,487 A * 6/1998 Natsume ..... 361/775
6,309,257 B1 * 10/2001 Huang ..... 439/731
6,431,887 B1 8/2002 Yeomans et al.
6,457,987 B1 * 10/2002 Yeh ..... 439/352
6,585,536 B1 * 7/2003 Wu ..... 439/358
6,585,537 B1 7/2003 Lee
6,617,939 B1 * 9/2003 Vermeersch ..... 333/28 R
6,655,979 B1 12/2003 Lee
6,790,087 B2 * 9/2004 Ho ..... 439/606
6,821,139 B1 11/2004 Wu
6,830,472 B1 12/2004 Wu
6,860,749 B1 3/2005 Wu
6,860,750 B1 3/2005 Wu
6,890,205 B1 5/2005 Wu
6,896,540 B1 5/2005 Wu
6,974,911 B2 * 12/2005 Hyde ..... 174/74 R
2001/0044227 A1 * 11/2001 Boutros et al. ..... 439/76.1

OTHER PUBLICATIONS

"SFF-8087 Specification for Compact Multilane Unshielded Connector" Rev. 1.31, published on Jun. 27, 2005 by SFF Committee.

* cited by examiner

*Primary Examiner*—Alexander Gilman
(74) *Attorney, Agent, or Firm*—Wei Te Chung

(57) ABSTRACT

A cable connector assembly (100) includes a front housing piece (1), a printed circuit board (3) electrically connected with a number of cables (4) and assembled to the front housing piece (1), a rear housing piece (2) enclosing junctions between the cables and the printed circuit board and assembled to the front housing piece, and a locking member (6) including a retaining portion assembled to the front housing piece, a pressing portion engaging with the rear housing piece and a locking portion between the pressing portion and the retaining portion for locking with a complementary connector. The printed circuit board forms a number of through holes (33), and a number of bolts (8) protruding through positioning cavities (14) of the front housing piece and into the through holes.

22 Claims, 32 Drawing Sheets

CABLE CONNECTOR ASSEMBLY WITH INTERNAL PRINTED CIRCUIT BOARD

BACKGROUND OF THE INVENTION

1. Field of the Invention

The present invention relates to a cable connector assembly, and more particularly to a cable connector assembly used for high-speed signal transmission.

2. Description of Related Art

A committee called SFF is an ad hoc group formed to address storage industry needs in a prompt manner. When formed in 1990, the original goals were limited to define de facto mechanical envelopes within disk drives can be developed to fit compact computer and other small products. Specification SFF-8087 defines physical interface and general performance requirements of the mating interface for a Compact Multilane Connector which is designed for using in high speed serial interconnect applications at speeds up to 10 Gigabits/second. The Compact Multilane Connector defined in the SFF-8087 comprises a printed circuit board, a plurality of high-speed cables and low-speed wires respectively electrically connected with the printed circuit board to form a plurality of junctions therebetween, a PVC housing overmolding to the printed circuit board and the cables. The PVC housing comprises a rectangular body portion enclosing the junctions and a pair of tongue portions respectively extending forwardly from the body portion. The front portion of the printed circuit board is exposed between the pair of tongue portions for electrically connecting with a complementary connector. The Compact Multilane Connector also comprises a latch member assembled to a top surface of the body portion of the housing for latching with the complementary connector.

However, PVC material is relatively soft, thus, the PVC housing is not rigid enough to realize the mating function with the complementary connector with imperfect guiding effect. Furthermore, the specification generally defines electrical and mechanical requirements and high frequency performance requirements as well as outside connector dimensions for reference. Detailed structures of the connector are not provided, such as the connection between the printed circuit board and the housing, and the connector still has room to be improved for achieving perfect signal transmission effect or complying the requirements described in the SFF-8087 more coincidently.

Hence, an improved cable connector assembly is desired to address the problems stated above.

SUMMARY OF THE INVENTION

An object of the present invention is to provide a cable connector assembly for mating with a complementary connector more reliably.

To achieve the above object, a cable connector assembly in accordance with the present invention comprises a rear housing piece, a cable and a printed circuit board electrically connecting with each other and respectively partially received in the rear housing piece, a front housing piece assembled with the rear housing piece and defining a receiving slot to permit a front portion of the printed circuit board exposed outside the rear housing piece to extend through and be exposed between a pair of parallel tongue sections thereof, and a locking member assembled with one of the front housing piece and the rear housing piece. The cable connector assembly further comprises retaining means assembling the rear housing piece to the front housing piece and engaging means locking the printed circuit board to one of the front housing piece and the rear housing piece reliably.

Other objects, advantages and novel features of the invention will become more apparent from the following detailed description when taken in conjunction with the accompanying drawings.

DETAILED DESCRIPTION OF THE INVENTION

Figure 1:
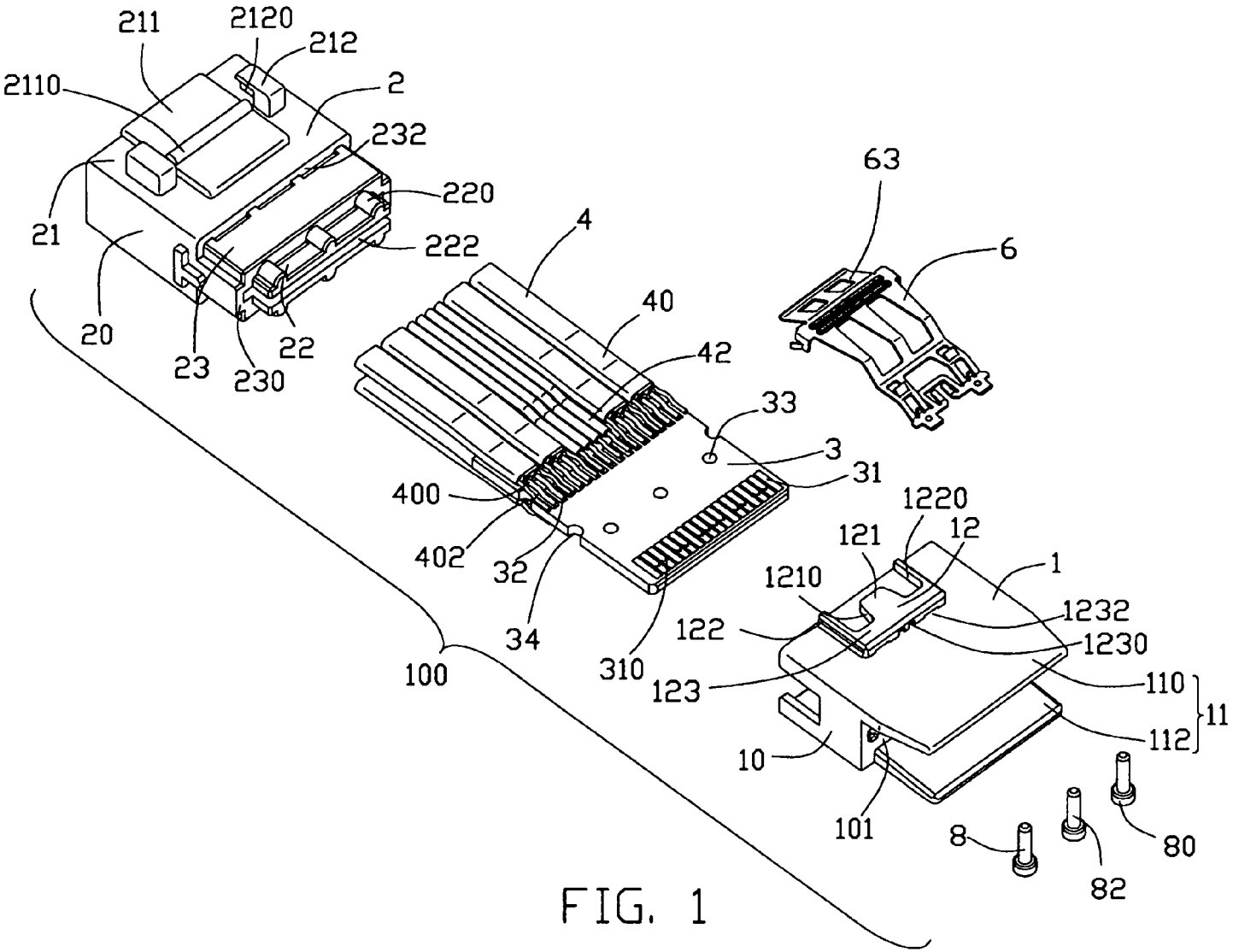
FIG. 1 is an exploded, perspective view of a cable connector assembly in accordance with the first embodiment of the present invention.
Figure 2:
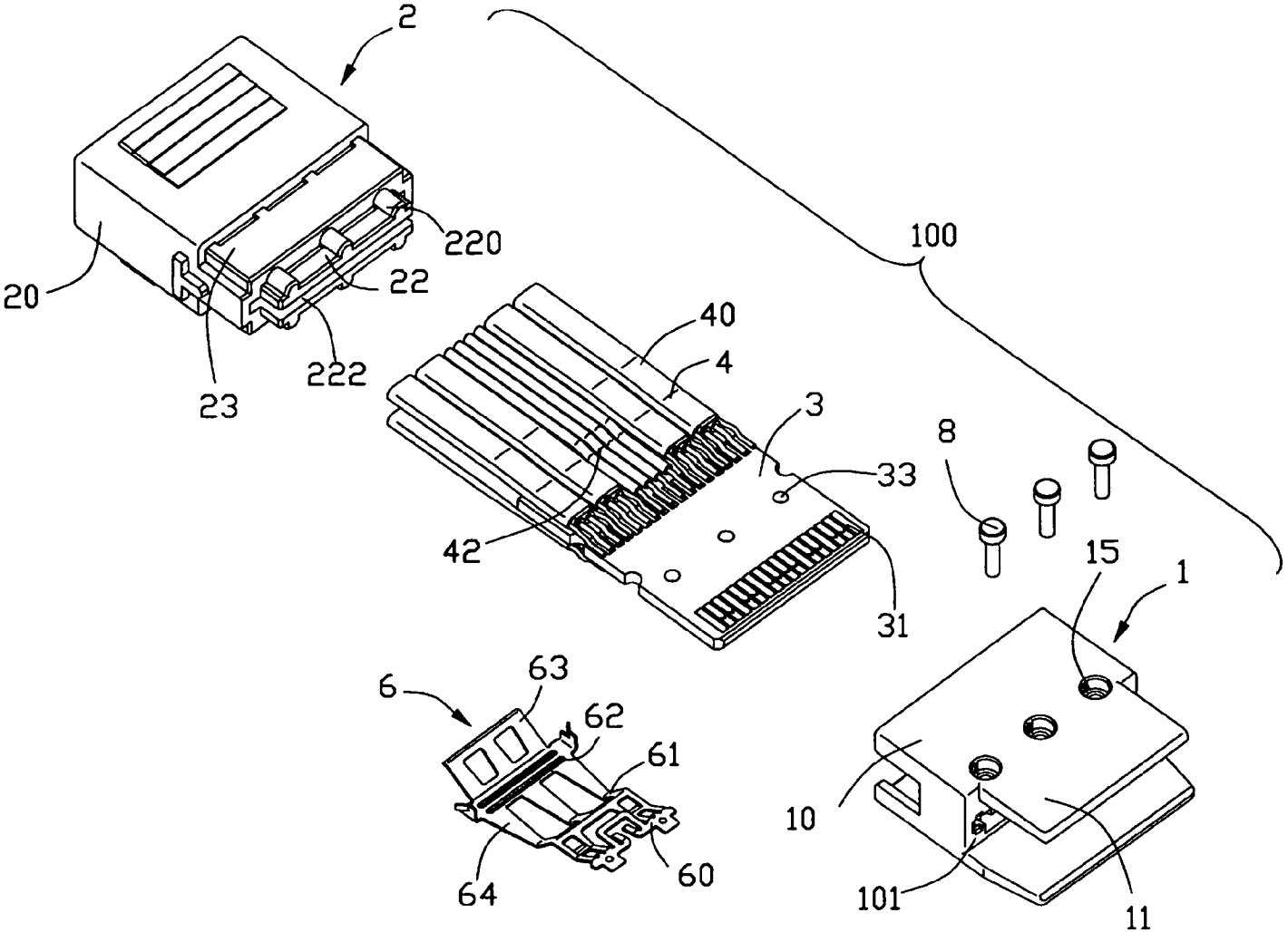
FIGS. 2-3 are views similar to FIG. 1, but taken from different aspects.
Figure 3:
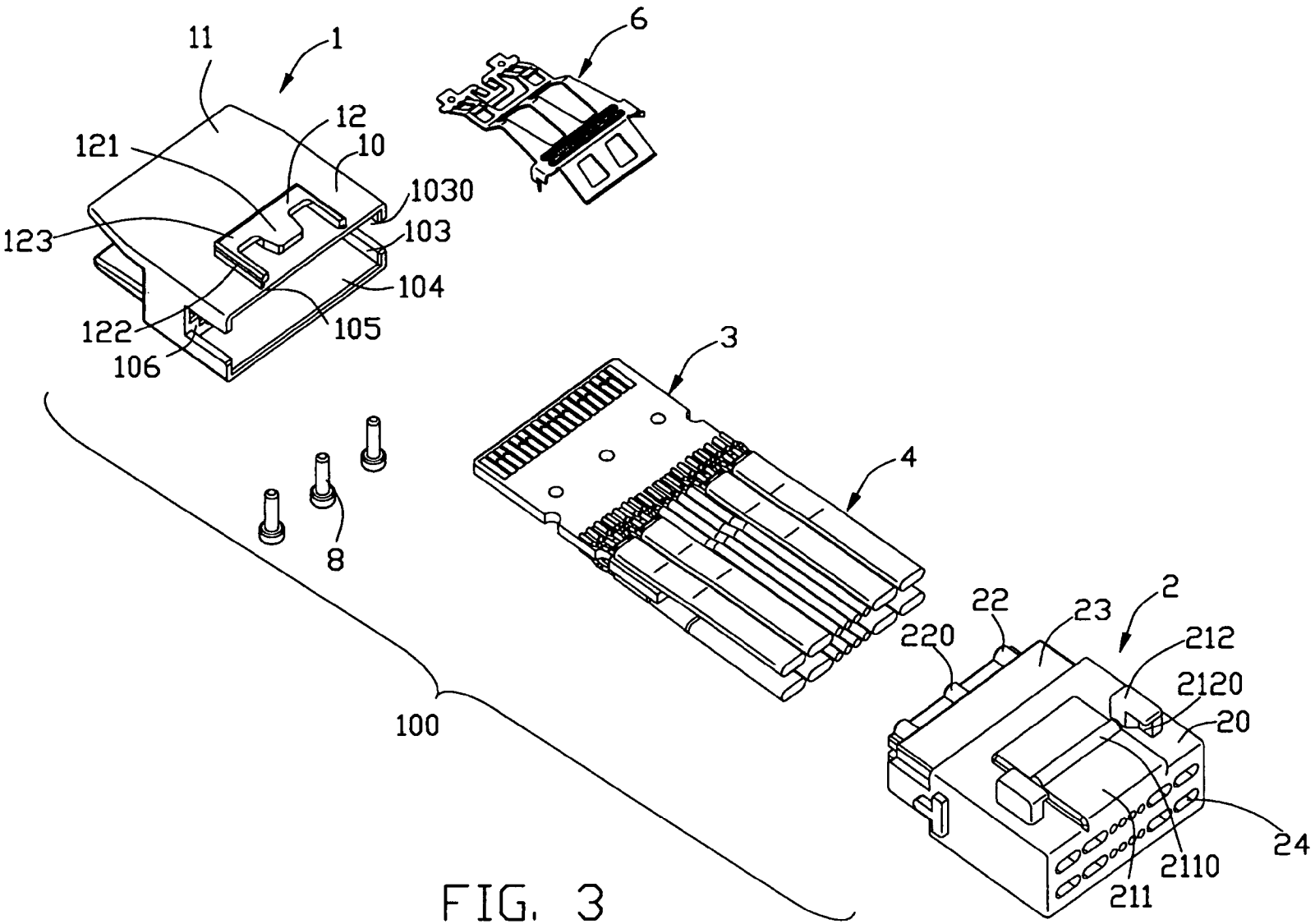
Figure 4:
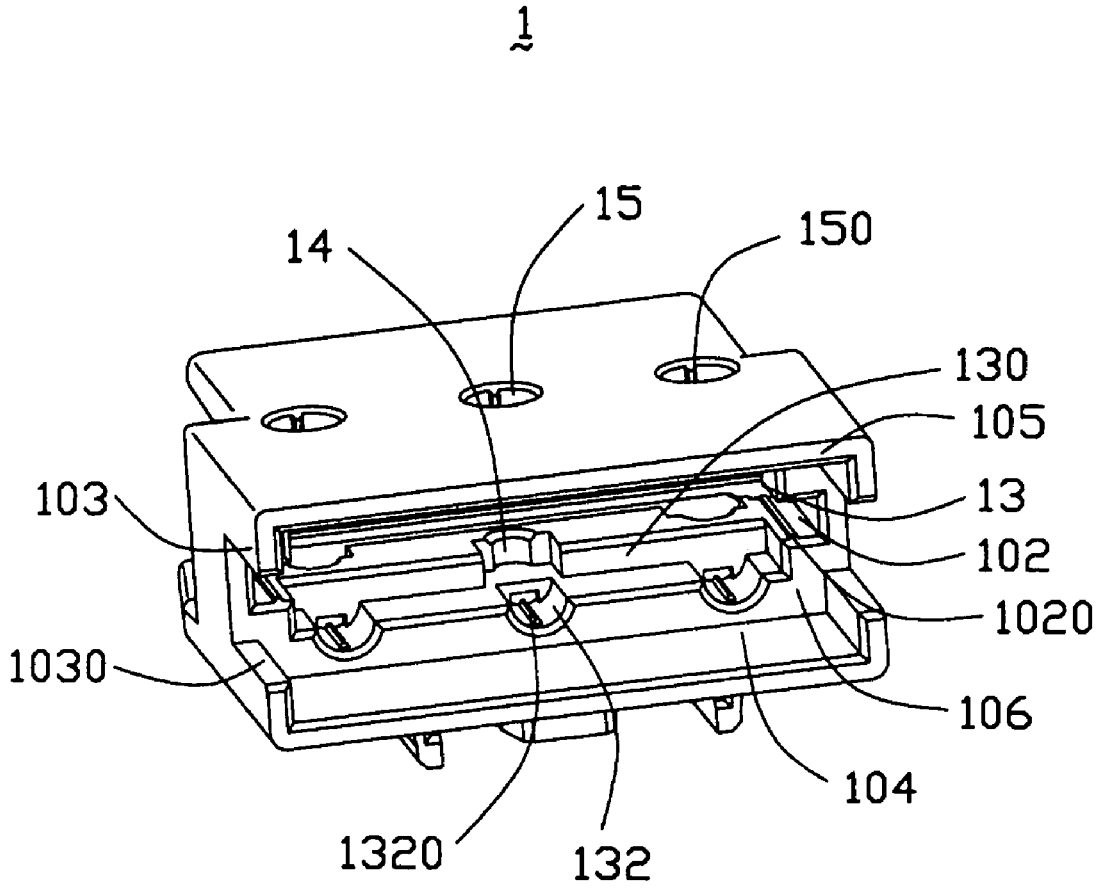
FIGS. 4-5 are perspective views of a front housing piece of the cable connector assembly, and viewed from different aspects.
Figure 5:
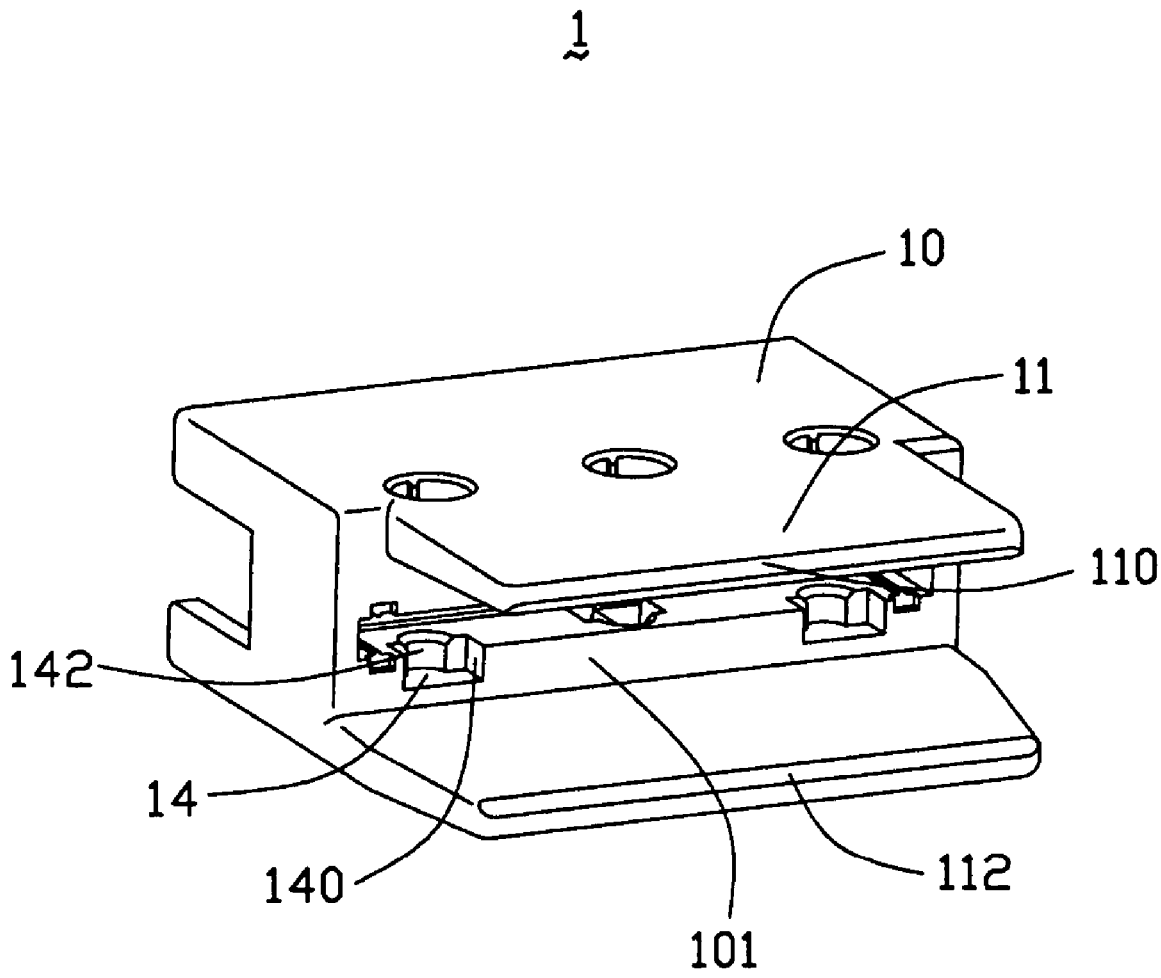

Referring to FIGS. 1 to 3, a cable connector assembly 100 in accordance with the first embodiment of the present invention comprises a front housing piece 1 and a rear housing piece 2 forming a housing member 7 (FIG. 9), a printed circuit board 3 assembled to the housing member 7, a plurality of cables 4 electrically connected with the printed circuit board 3, and a locking member 6 assembled to the housing member 7 for locking with a complementary connector.

Referring to FIGS. 1-5 in conjunction with FIGS. 12-16, the front housing piece 1 is made of insulative material with enough rigidity or other material, such as metal. The front housing piece 1 comprises a rectangular body portion 10 defining a central receiving slot 102 therethrough, and a tongue portion 11 consisting of first and second tongue sections 110, 112 respectively extending forwardly from a front surface 101 of the body portion 10.

The body portion 10 defines a rectangular receiving space 104 recessed forwardly from a rear surface thereof to communicate with the receiving slot 102, and thus, forming a pair of longitudinal walls 105, a pair of lateral walls 103, and a front inner face 106. A cutout 1030 is defined in each lateral wall 103 and communicates with the outmost lateral surface of the lateral wall 103 and the receiving space 104. The receiving slot 102 recesses forwardly from the front inner face 106 to the front surface 101 of the body portion 10 and forms a pair of upper and lower surfaces opposite to each other and perpendicular to the front inner face 106. A pair of ribs 1020 are formed at opposite sides of each of the upper and lower surfaces of the receiving slot 102 and extend from the front inner surface 106 to the front surface 101. A rectangular recess 13 recesses forwardly from the front inner face 106 with larger dimension in a vertical direction and smaller dimensions in lateral and front-back directions than those of the receiving slot 102, and thus forming a pair of step surfaces 130 between upper and lower surfaces thereof and the upper and lower surfaces of the receiving slots 102. Two sets of triple semi-circular receiving openings 132 are respectively depressed from the upper and lower surfaces of the recess 13 and respectively extend from the front inner face 106 to the step surfaces 130. Each receiving opening 132 forms a rim 1320 on inner peripheral thereof. Two sets of triple positioning cavities 14 are respectively depressed from upper and lower surfaces of the receiving slot 102 and aligned with corresponding sets of triple receiving openings 132 along the front-back direction. One positioning cavity 14 opens toward the step surface 106 and the other two positioning cavities 14 open toward the front surface 101. Each positioning cavity 14 consists of a rectangular section 140 and an arc section 142 communicating with the rectangular section 140. Triple circular depressions 15 extend upwardly from a bottom surface of the body portion 10 to respectively communicate with one set of triple positioning cavities 14. Each circular depression 15 has a larger semidiameter than that of the arc section 142 of the positioning cavity 14 and forms a pair of vertically-extending rims 150 on inner peripheral thereof.

The body portion 10 forms an M-shape engaging portion 12 on a top surface and adjacent to the rear surface thereof. The engaging portion 12 comprises a protruding section 121 and a pair of arms 122 located at opposite sides of the protruding section 121, all extending rearward from a transverse main section 123. A slit 1210 (FIG. 15 and FIG. 16) is formed between the protruding section 121 and a top surface of the body portion 12 and extends into the main section 123. A pair of grooves 1220 are respectively formed in the arms 122 and open toward each other. A pair of first slots 1230 and a pair of second slots 1232 located at opposite outer sides of the first slots 1230 are recessed from a front surface of the main section 123 to communicate with the slit 1210, respectively.

The rear housing piece 2 of the present invention is made of PVC material. In other embodiments, the rear housing piece 2 also can be made from other material, same as that of the front housing piece 1 or different from that of the front housing piece 1. The rear housing piece 2 comprises a main portion 20 and a forwardly-projecting holding portion 22. The main portion 20 forms a flat extruding section 211 protruding upwardly from an upper surface thereof and located at a rear portion thereof, and a pair of ear sections 212 located at opposite sides of the extruding section 211. The extruding section 211 forms a transverse bar-shape pivot section 2110 on middle thereof. A pair of recesses 2120 are respectively formed between the top surface of the main portion 20 and the pair of ear sections 212 with opening toward each other. A front portion of the main portion 20 is partially cut to form a front guiding section 23 and a rear body 21. The guiding section 23 forms a pair of guiding projections 230 on opposite sides thereof with outmost surface of each guiding projection 230 coplanar with the body 21. A plurality of cutouts 232 are defined in a rear of the guiding section 23 adjacent to the body 21. The holding portion 22 extends forwardly from a front surface of the guiding section 23 and comprises three pairs of semicircular columns 220, on opposite upper and lower sides thereof with each pair of columns 220 aligning with each other in the vertical direction. A through slot 222 extends through the holding portion 22 with a width equal to the holding portion 22 and into the guiding section 23 with a larger width than the part in the holding portion 22 for receiving the printed circuit board 3.

The printed circuit board 3 forms a plurality of first conductive pads 31 at front end thereof and a plurality of second conductive pads 32 at a middle thereof. The conductive pads 31, 32 are arranged on opposite upper and lower surfaces of the printed circuit board 3. Triple through holes 33 are disposed between the first and second conductive pads 31, 32. Each side edge of the printed circuit board 3 defines a pair of semi-circular positioning holes 34 arranged along the front-back direction. To realize hot plug function, the first conductive pads 31, which are used for signal transmission, are formed with V-shape cutouts 310 to let the first conductive pads 31, which are used for grounding, to mate with the complementary connector firstly and break from the complementary connector lastly. Such V-shape cutout structure assures the signal transmission without dimple. Of course, the V-shape cutout also can be omitted here or have other configuration.

The cables 4 consist of two sets of sub-assemblies in a stacked relationship. Each set comprises four serial Attached Technology Attachment (ATA) standard cables 40 for high speed signal transmission and four single ended wires 42 for low speed signal transmission. Of course, the single ended wires 42 may not be included into the cable set in the first embodiment or other embodiments according to different requirements. Each Serial ATA standard cable 40 comprises a pair of signal conductors 400 respectively transmitting positive signal and negative signal, and a pair of grounding conductors 402 arranged at opposite outer sides of the pair of signal conductors 400 for providing grounding to the signal transmission.

Figure 6:
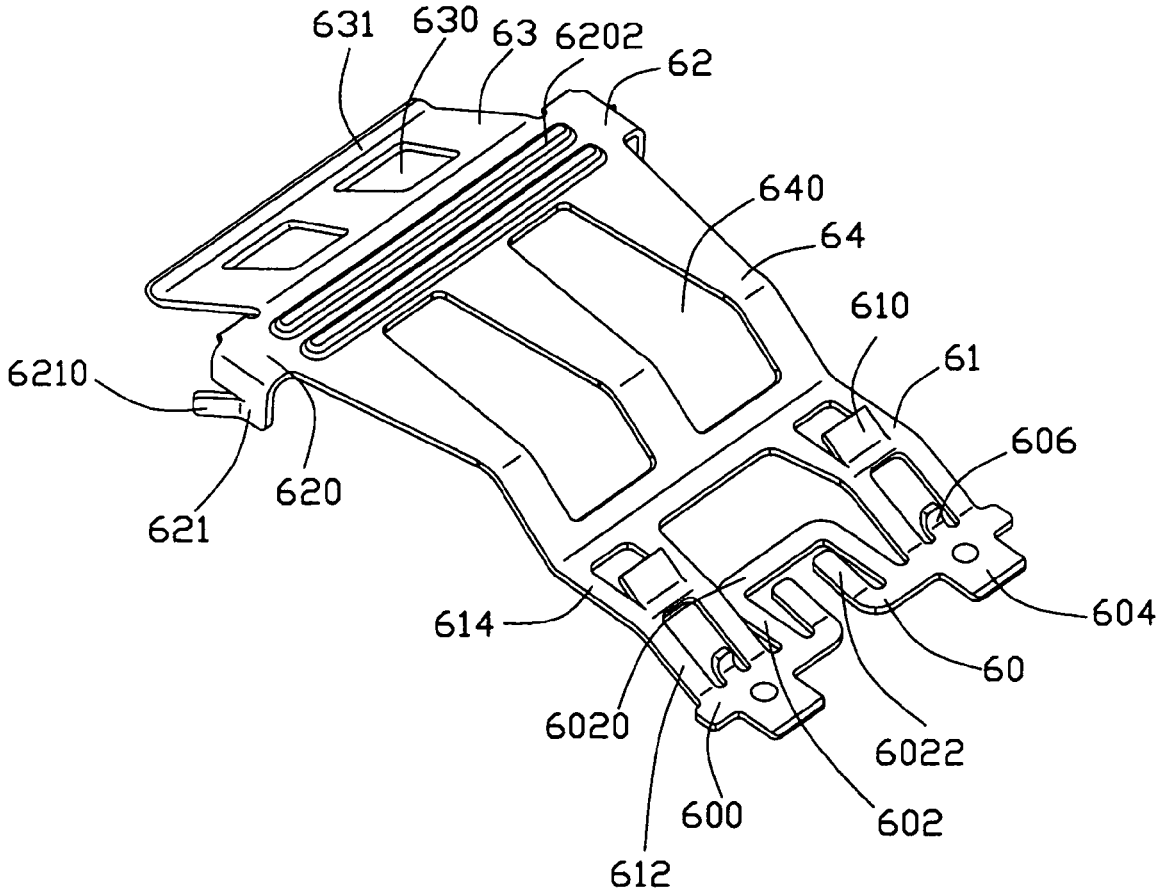
FIG. 6 is a perspective view of a locking member of the cable connector assembly.

Referring to FIG. 6, the locking member 6 is stamped and formed from a metallic plate and comprises a retaining portion 60, a pair of generally L-shape locking portions 61 extending upwardly and rearwardly from the retaining portion 60, a.N-shape pressing portion 62 formed at a rear position of the pair of locking portions 61, and an inclined supporting portion 63 slantwise extending from the pressing portion 62. The locking member 6 further forms a generally L-shape intermediate portion 64 connecting the pressing portion 62 with the locking portions 61.

The retaining portion 60 has a pair of transverse bar sections 600 respectively connecting with front edges of the locking portions 61, an engaging section 602 connecting with opposite inner ends of the pair of bar sections 600 and extending rearward from the bar sections 600, and a pair of positioning sections 604 respectively extending forwardly from front edges of the pair of bar sections 600. Outmost end of each bar section 600 extends beyond outmost edge of corresponding locking portion 61 and served as guiding means for the locking member 6. The engaging section 602 is located between the pair of locking portions 61 and comprises a rectangular frame 6020 located in a horizontal surface and a pair of elastic snapping sections 6022 extending into the space circumscribed by the frame 6020 with distal ends bending upwardly. Each locking portion 61 comprises an inclined first section 612 extending rearward and upwardly from the retaining portion 60 and a flat second section 614 extending rearward from the first section 612 to connect with the intermediate portion 64. The inclined first section 612 defines a cutout therein for increasing flexibility thereof. The second section 614 is formed with a pair of latch sections 610 extending upwardly and rearward from a front portion thereof. A pair of stop sections 606 are respectively formed with the bar sections 600 and extend into the cutout (not labeled) of the first sections 612 and curve upwardly. The pressing portion 62 comprises a body section 620 and a pair of side beams 621 extending downwardly from opposite lateral ends of the body section 620. Each side beam 621 is formed with a spring tab 6210 extending outwardly therefrom. The body section 620 is formed with a plurality of ribs 6202 for facilitating handling. The supporting portion 63 defines a pair of rectangular openings 630 and forms a curved edge 631 at a free end thereof. The intermediate portion 64 defines a pair of elongated cutouts 640. The openings 630 and the cutouts formed in the second sections 614 of the locking portion 61 and the intermediate portion 64 are defined for perfect deformation of the locking portion 61 and the supporting portion 63.

Figure 7:
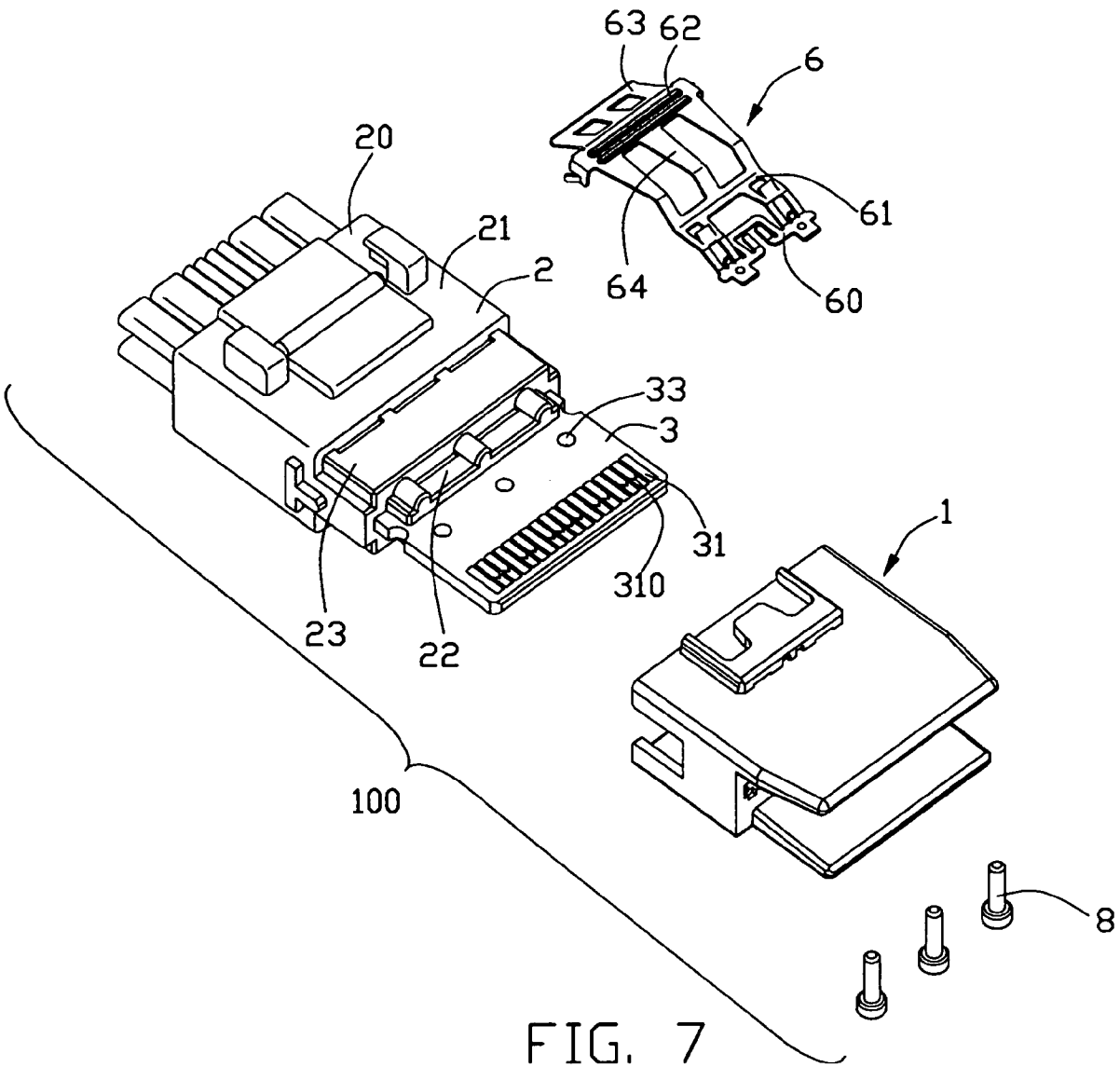
FIGS. 7-8 are partially assembled views of FIGS. 1-2.
Figure 8:
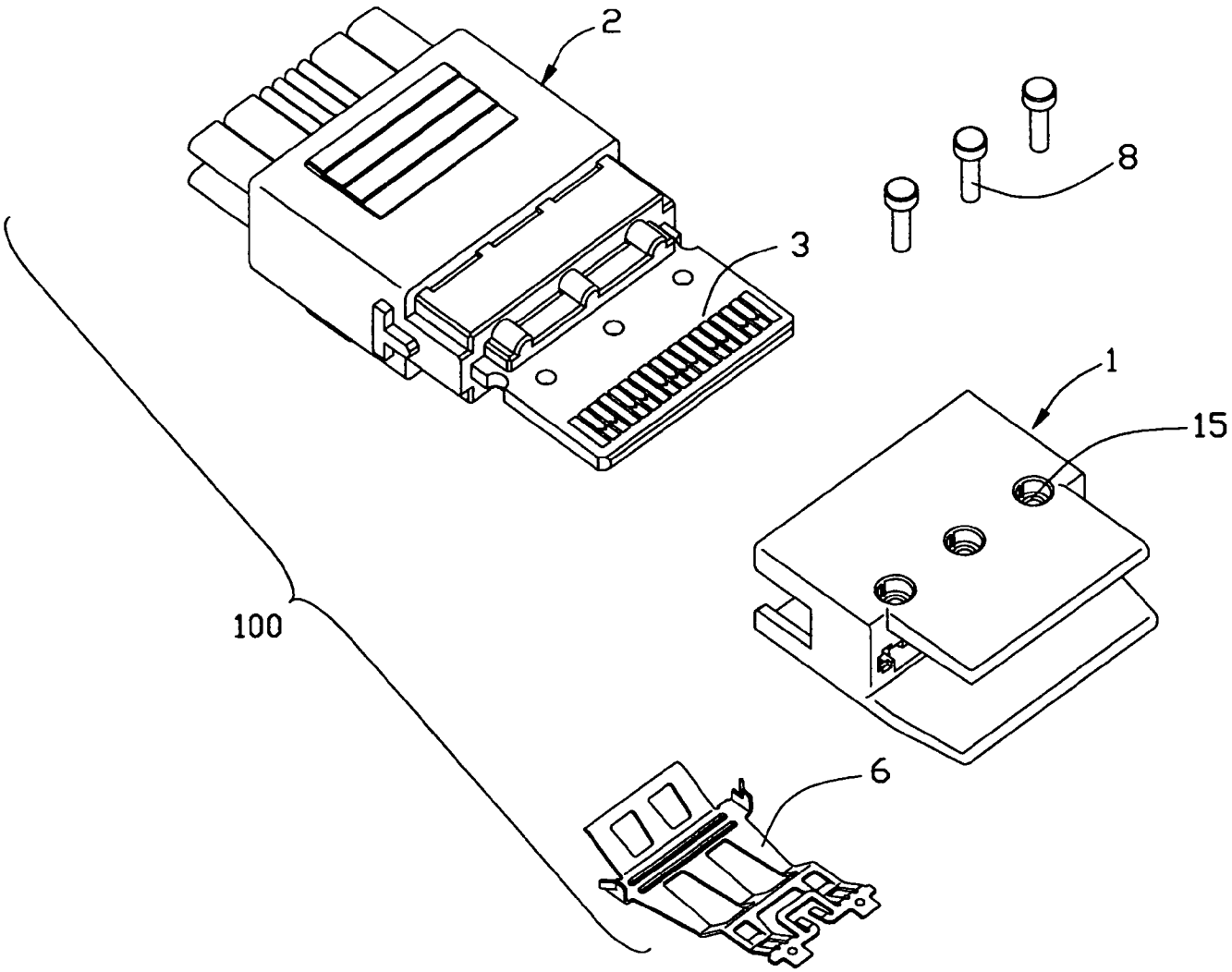

Referring to FIGS. 7-8 in conjunction with FIGS. 1-3, in assembly of the cable connector assembly 100, the two sets of cables 4 are respectively soldered to the second conductive pads 32 located on the upper and lower surfaces of the printed circuit board 3. The rear housing piece 2 is then over molded to the printed circuit board 3 and the cables 4 with the rear portion of the printed circuit board 3 is received in the through slot 222 formed in the holding portion 22 and the guiding section 23, and the cables 4 protruding through a plurality of different-size receiving passages 24 formed in the rear housing piece 2 and exposing out of a rear surface of the rear housing piece 2. The pair of positioning holes 34 located at a relatively rear position are filled with material of the rear housing piece 2 to increasing the retaining force between the rear housing piece 2 and the printed circuit board 3. Of course, the rear housing piece 2 can be molded in first and then is pushed forwardly toward the cables 4 and the printed circuit board 3 to enclose the junctions between the cables 4 and the printed circuit board 3.

Figure 9:
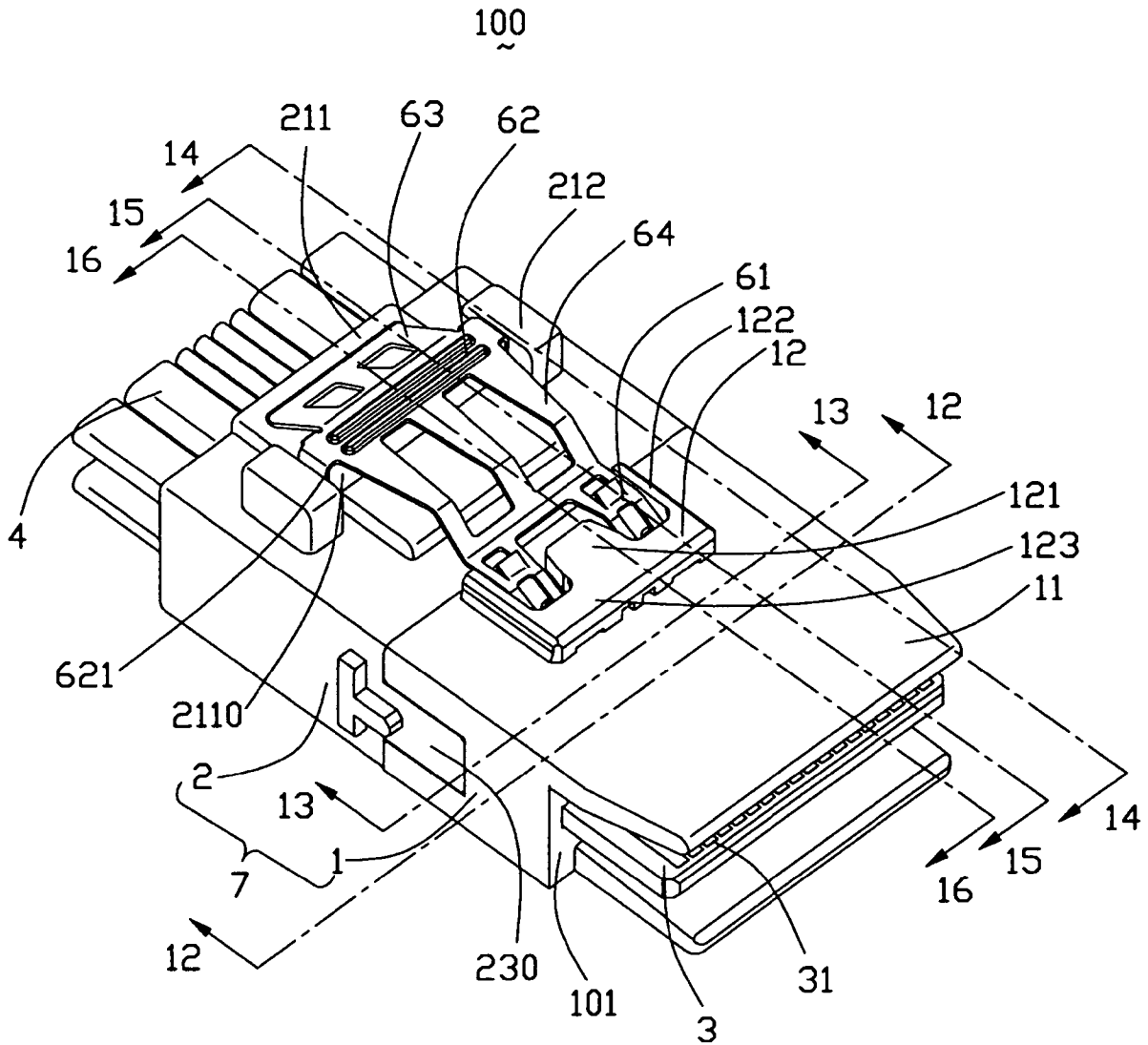
FIGS. 9-11 are assembled views of the cable connector assembly of FIGS. 1-3.
Figure 10:
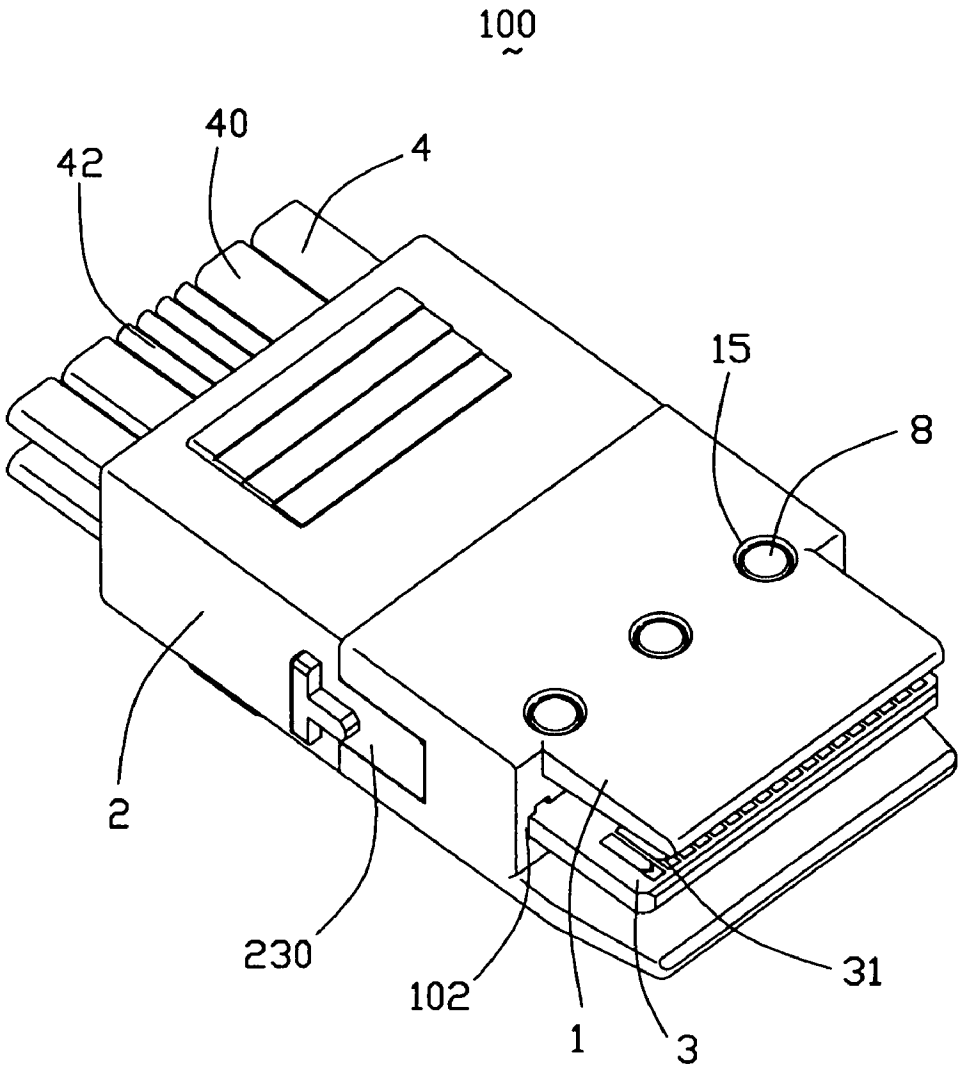
Figure 11:
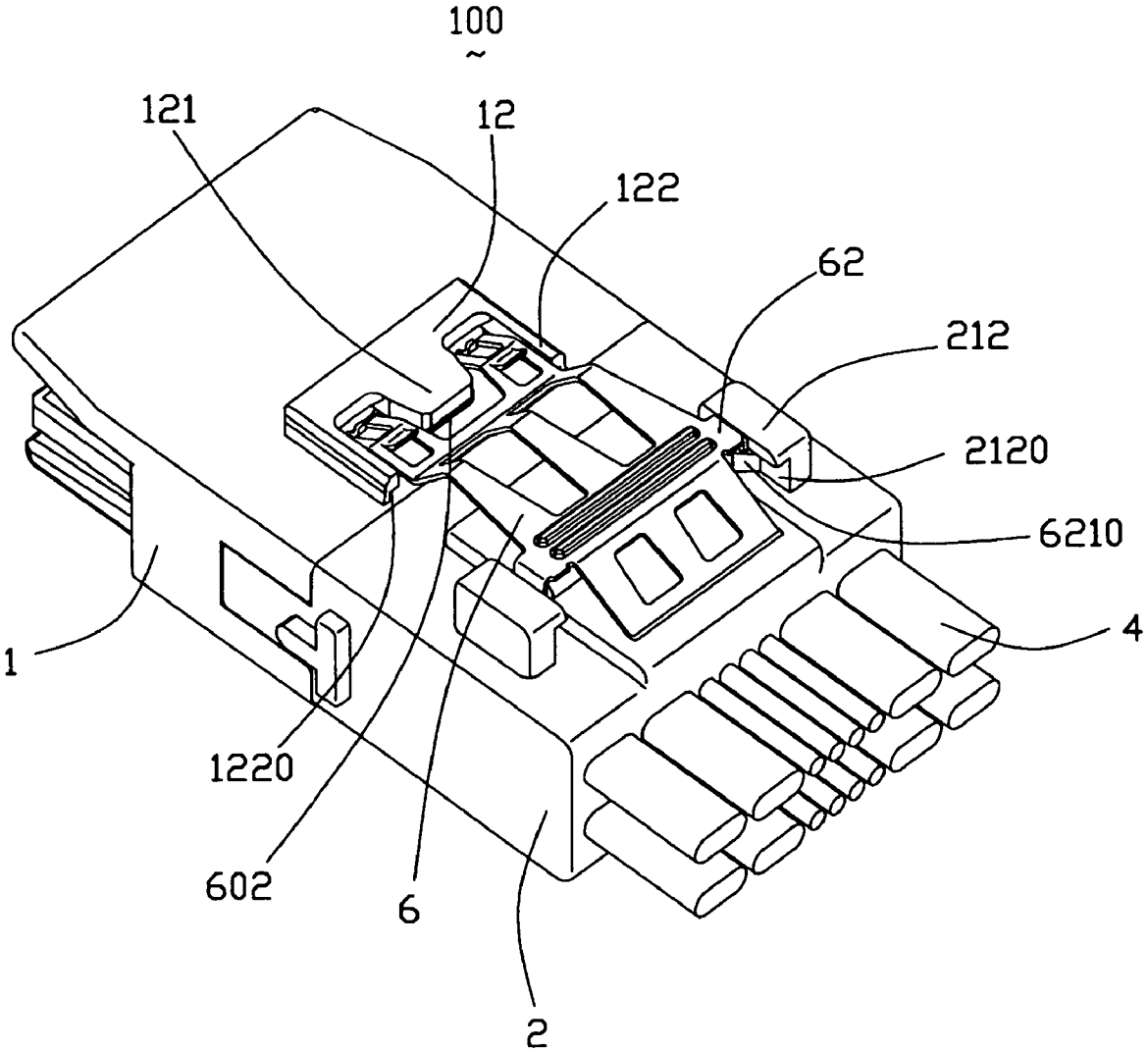
Figure 12:
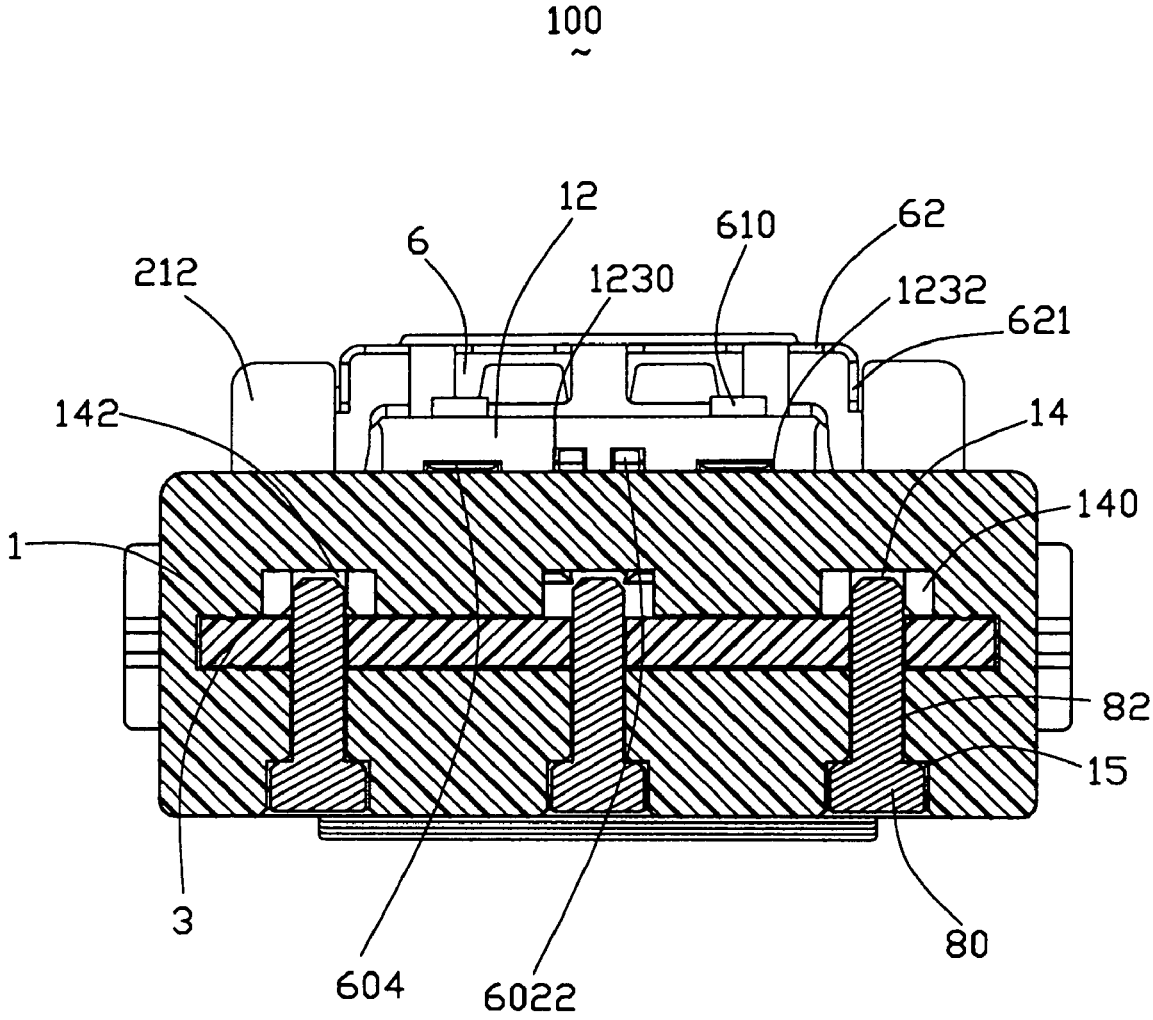
FIGS. 12-16 are cross-section views of the cable connector assembly taken along lines 12-12 to 16-16 of FIG. 9.
Figure 13:
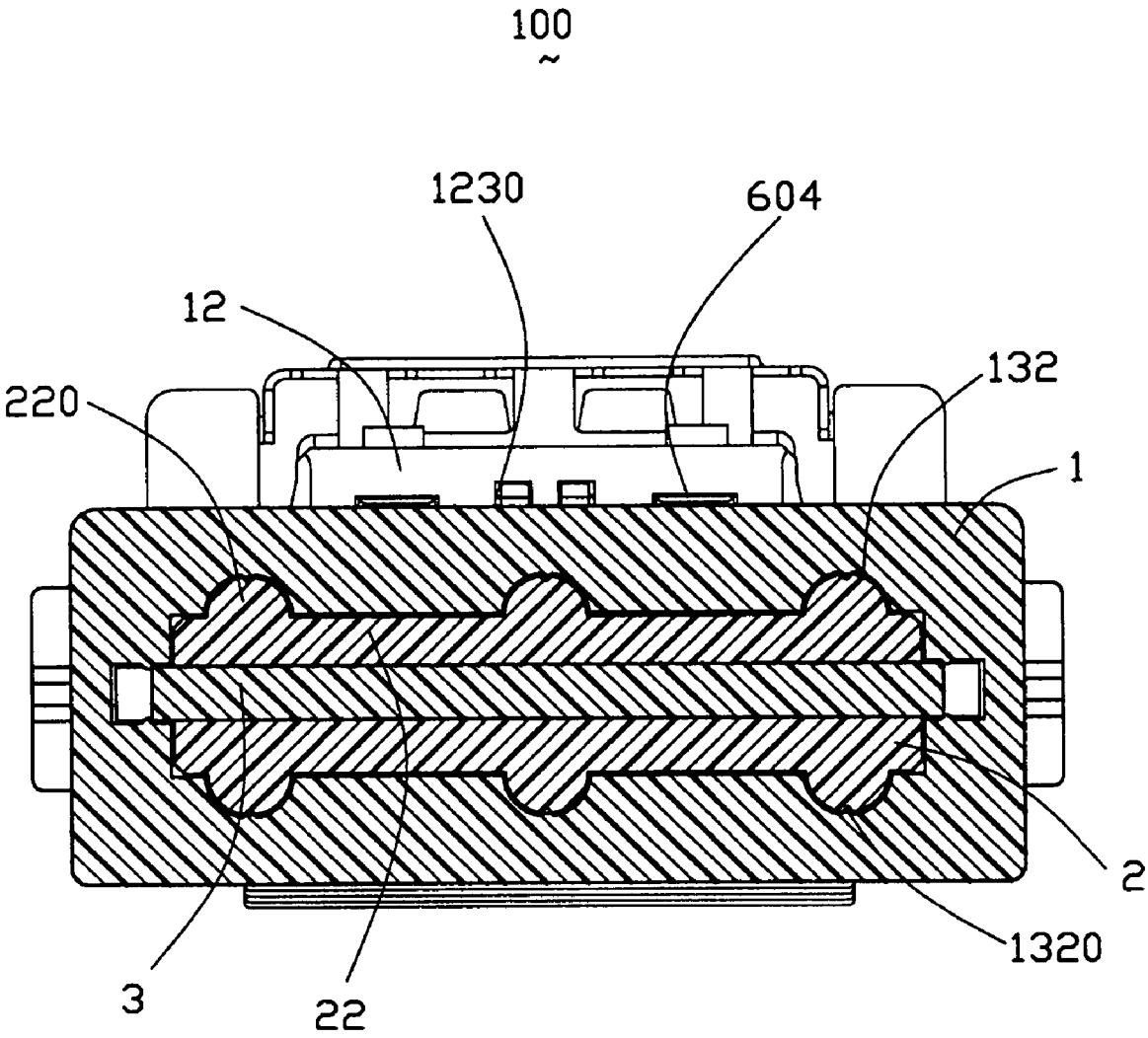
Figure 14:
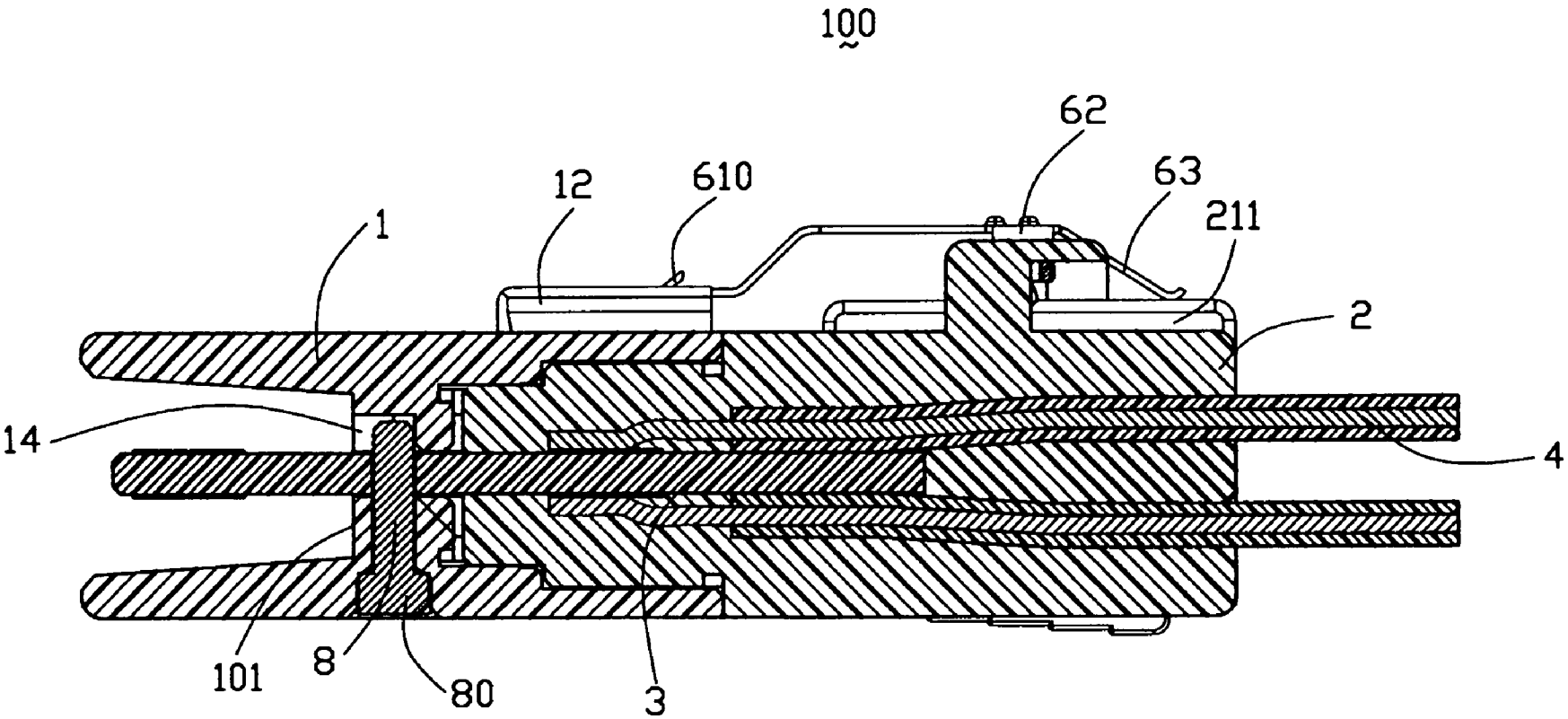
Figure 15:
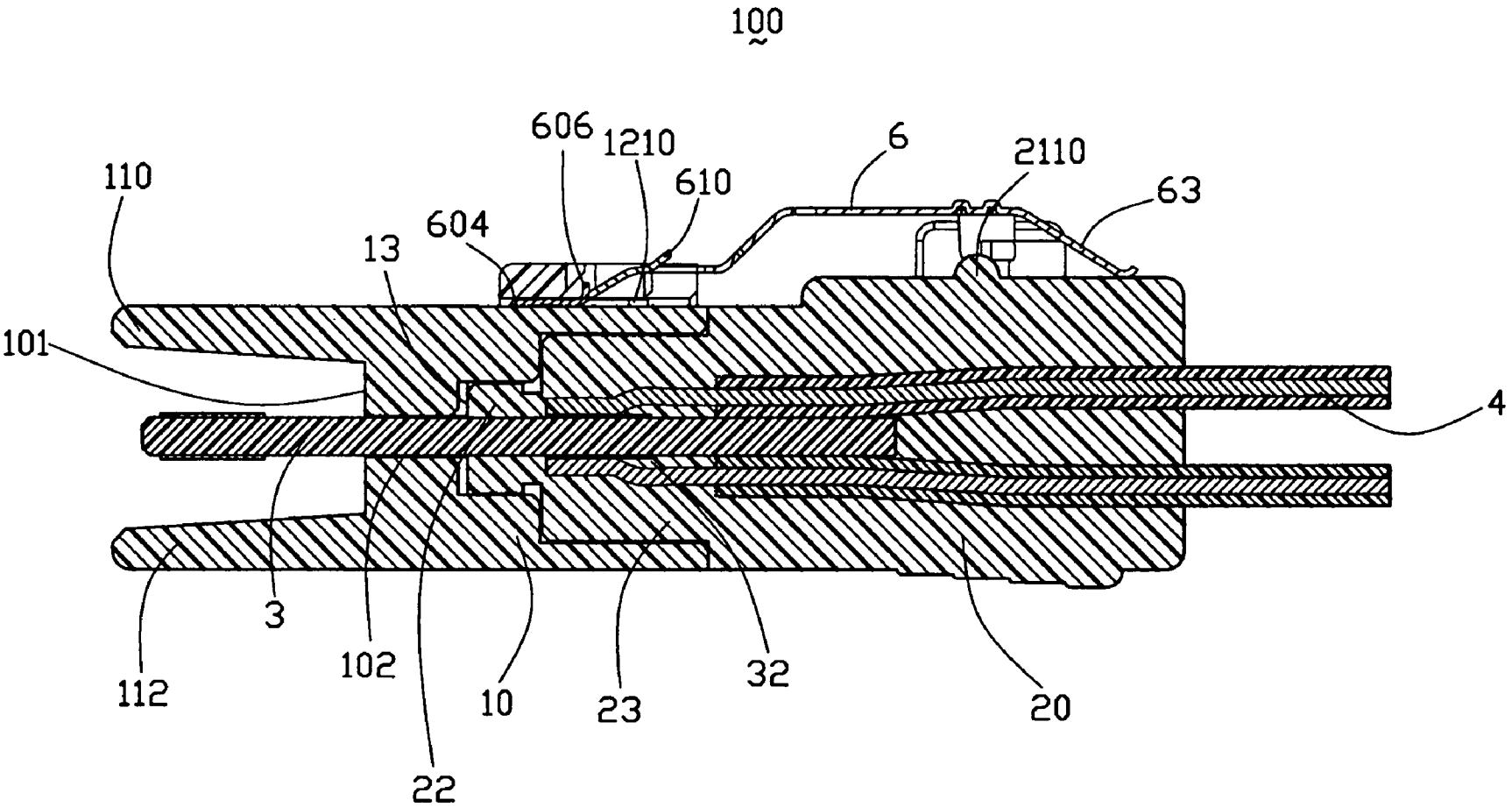
Figure 16:
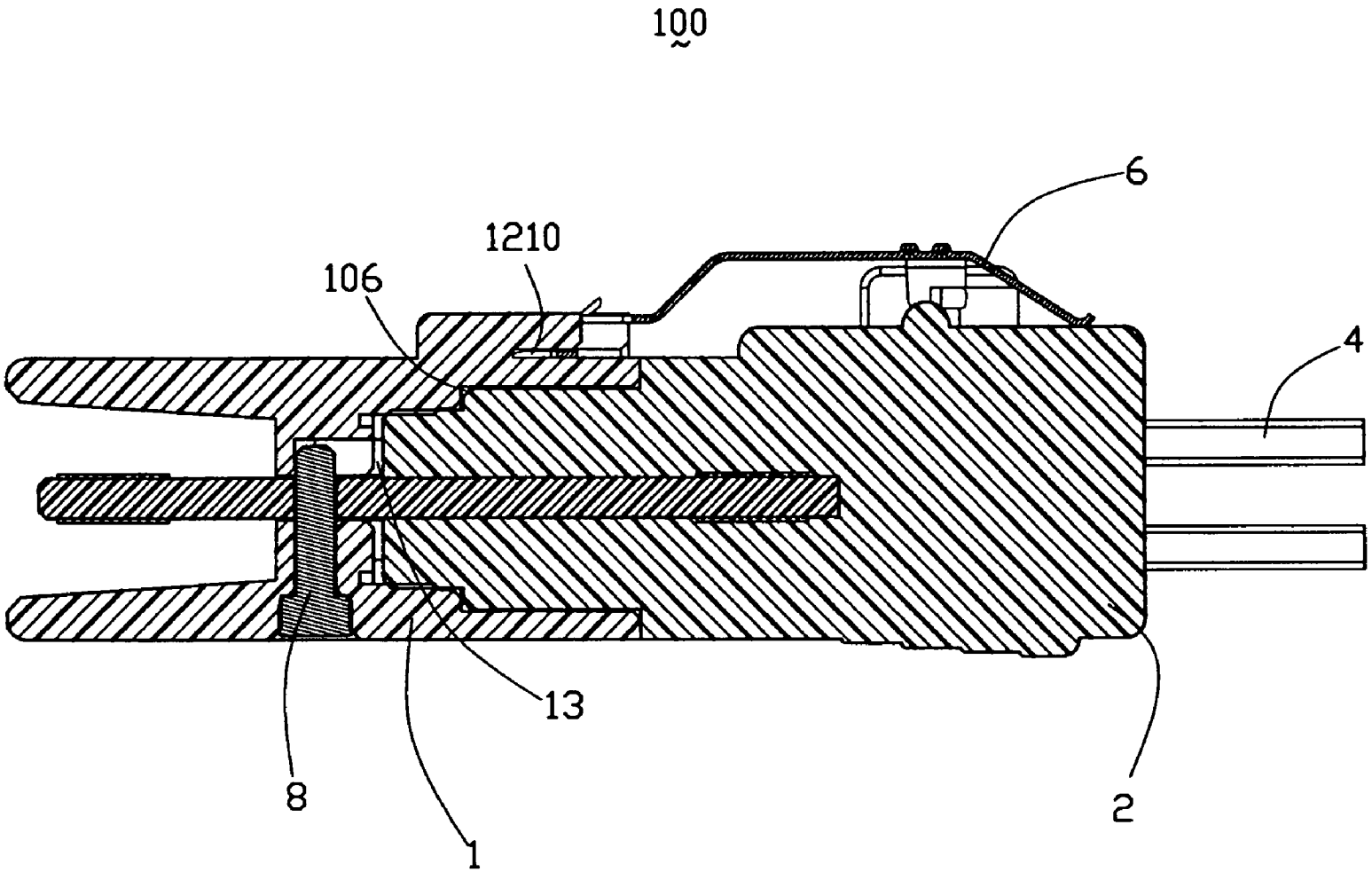

Referring to FIGS. 9-11 in conjunction with FIGS. 1-5, the rear housing piece 2 with the cables 4 and the printed circuit board 3 is assembled to the front housing piece 1 along the back-front direction. With the guidance of the pair of guiding projections 230 of the guiding section 23 sliding into the cutouts 1030 of the lateral walls 103, the front portion of the printed circuit board 2 protrudes through the receiving slot 12 to be exposed between the first and second tongue sections 110, 112 until a front surface of the rear housing piece 2 abuts against the front inner face 106 of the front housing piece 1. Thus, the holding portion 22 and the guiding section 23 of the rear housing piece 2 are respectively received in the rectangular recess 13 and the receiving space 104 of the front housing piece 1. The through holes 33 of the printed circuit board 3 respectively align with the arc sections 142 of the positioning cavities 14 and the circular depression 15. The ribs 1020 tightly press on the printed circuit board 3 to increase the retaining force between the printed circuit board 3 and the front housing piece 1. The three pairs of columns 220 of the holding portion 22 are respectively received in the receiving openings 132 of the front housing piece 1 with the rims 1320 of the receiving openings 132 compressing on outer peripheral of the columns 220 to increase the maintaining force between the front and rear housing pieces 1, 2. The columns 220 of the rear housing piece 2 and the receiving openings 132 of the front housing piece 1 serve as retaining means to lock the front and rear housing pieces 1, 2 together. In addition, to enhancing the combination of the front and rear housing pieces 1, 2, the present invention also spreads glue to the guiding section 23 and the holding portion 22 before assembling the rear housing piece 2 to the front housing piece 1. The cutouts 232 formed in the guiding section 23 are used to receive excrescent glue after assembly. To enhance the combination of the printed circuit board 3 and the front housing piece 1, three bolts 8 are employed. Each bolt 8 comprises a column portion 82 respectively protruding through the circular depression 15, lower positioning cavity 14, through hole 33 and into the upper positioning cavity 14, and an enlarged head portion 80 received in the circular depression 15 with the rims 150 compressing on the outer periphery of the head portion 80. Via the bolts 8, the printed circuit board 3 is reliably retained to the front housing piece 1 and has no possibility of being pulled out from the front housing piece 1 when user pulling the cables 4, further enhancing the engagement between the front and rear housing pieces 1, 2. The bolts 8 and the three through holes 33 serve as engaging means to position the printed circuit board 3 to the front housing piece 1.

Particularly referring to FIGS. 9 and 11 in conjunction with FIGS. 12-16, the locking member 6 is assembled to the front and rear housing pieces 1, 2. A forward pressing force is exerted on the locking member 6. The spring tabs 6210 of the pressing portion 62 respectively slide along the recesses 2120 of the ear sections 212 of the rear housing piece 2. At the same time, with the guidance of the outmost ends of the retaining portion 60 sliding along the grooves 1220 of the arms 122 of the front housing piece 1, the bar section 600 and the engaging section 602 are received in the slit 1210 with the positioning sections 604 and the snapping sections 6022 respectively locked into the first and the second slots 1230, 1232 to prevent the locking member 16 from moving rearwardly when the cable connector assembly 100 mates with the complementary connector. The pair of stop sections 606 locate in front of the main section 123 for preventing excessive forward movement of the locking member 6. The supporting portion 63 is located above the extruding section 211 of the rear housing piece 2 with the curved edge 631 abutting against a surface of the extruding section 211. The spring tabs 6210 of the pressing portion 62 elastically engage with inner surfaces of the recesses 2120 of the ear sections 212 for preventing the locking member 16 from escaping the recesses 2120 of the rear housing piece 2. The pressing portion 62 is downwardly movable relative to the rear portion of the rear housing piece 2 to deflect the locking portion 61 toward the front and rear housing pieces 1, 2.

The complementary connector has corresponding structure locking with the pair of latch sections 610 of the locking member 6 to realize the reliable engagement with the cable connector assembly 100. When the cable connector assembly 100 is to be separated from the complementary connector, a downward pressing force is exerted on the pressing portion 62 of the locking member 16. The pressing portion 62 moves downwardly until the body section 620 contacts with the pivot portion 2110 of the rear housing piece 2 and the locking portion 61 creates a vertical displacement toward the front housing piece 1. The body section 1620 then becomes curve toward the rear housing piece 2 under the pressing force with the locking portion 161 creating a further vertical displacement. The retaining portion 60 engaging with the front housing piece 1 and the supporting portion 63 pressing on the rear housing piece 2, thus, together form a girder. The vertical displacement of the locking portion 61, particularly the latch sections 610, is big enough to realize the unlock between the cable connector assembly 100 and the complementary connector easily.

A cable connector assembly 100' in accordance with the second embodiment of the present invention is illustrated in FIGS. 17-25 and comprises a front housing piece 1', a rear housing piece 2', the printed circuit board 3 same as the first embodiment, cables 4 same as the first embodiment, and the locking member 6 same as the first embodiment.

Figure 17:
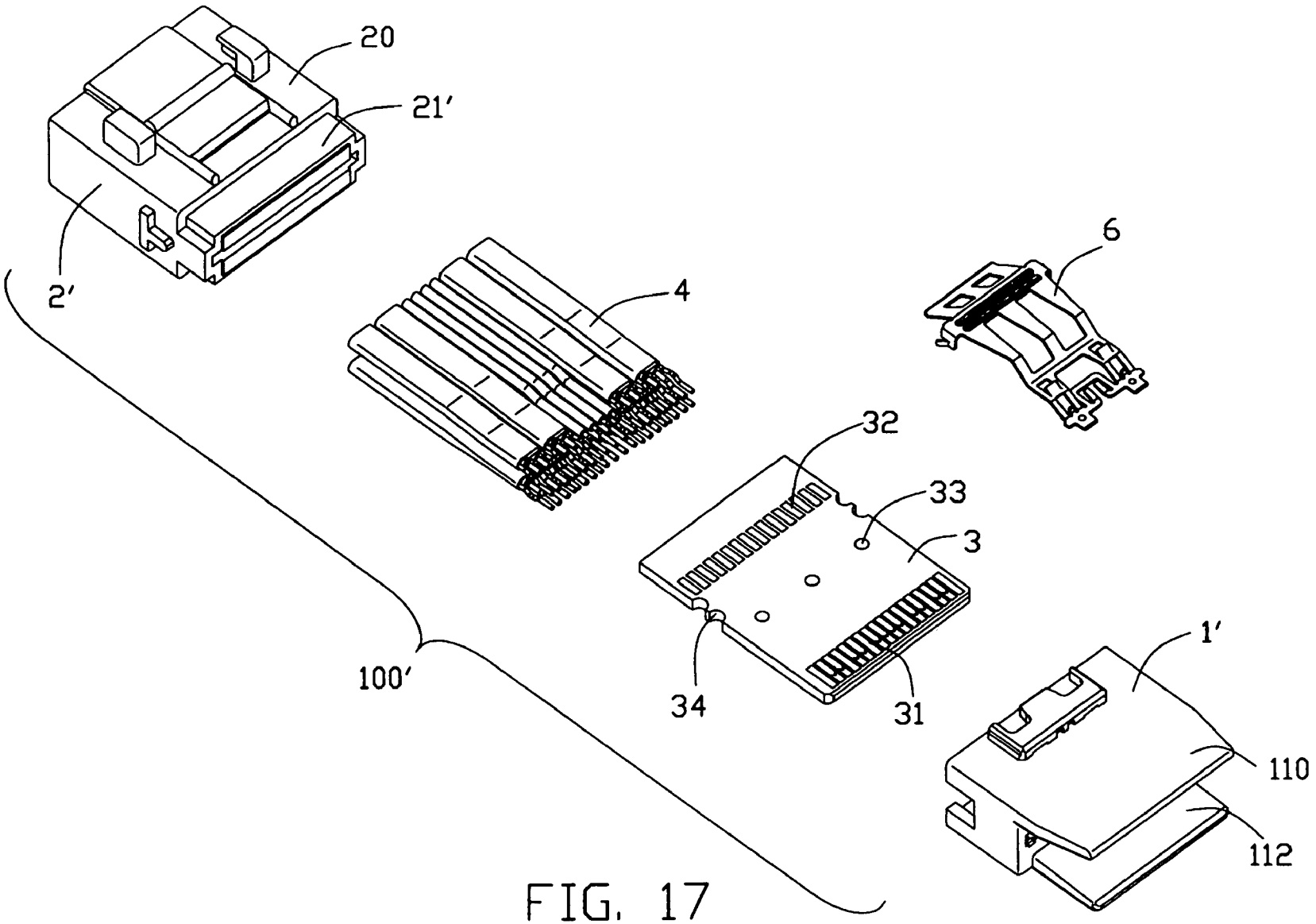
FIG. 17 is an exploded, perspective view of a cable connector assembly in accordance with the second embodiment of the present invention.
Figure 18:
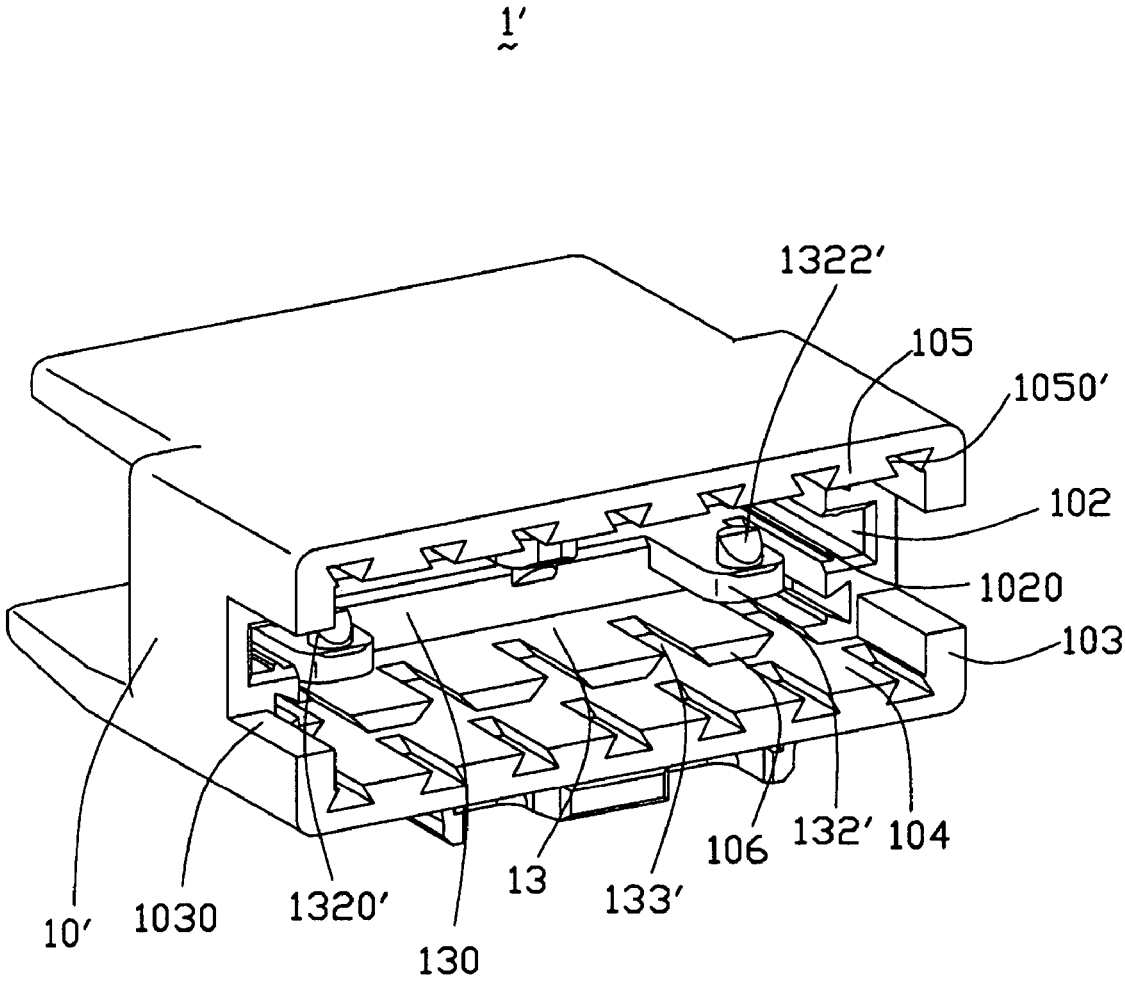
FIG. 18 is a perspective view of a front housing piece of FIG. 17 and viewed from another aspect.
Figure 19:
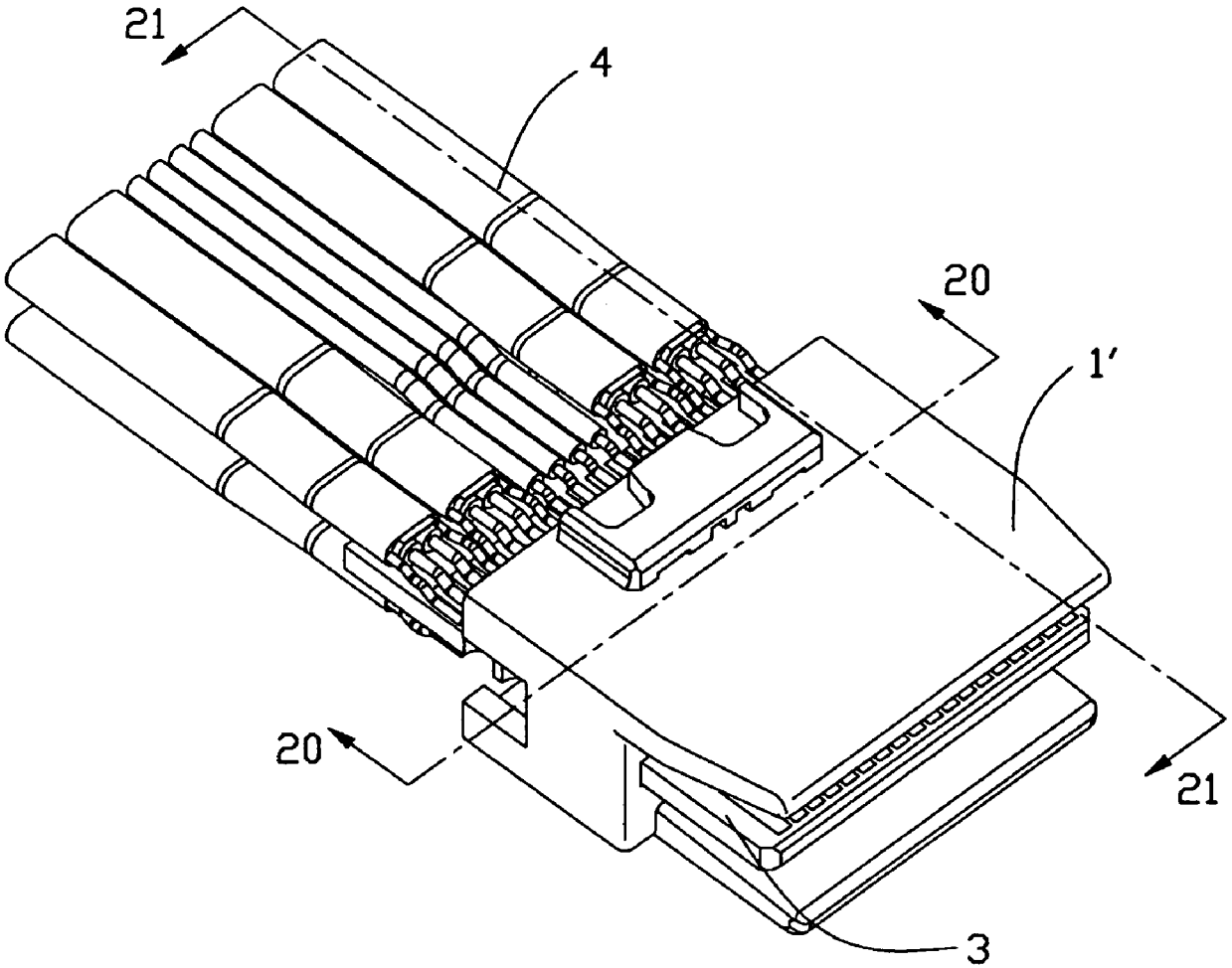
FIG. 19 is a partially assembled view of FIG. 17.
Figure 20:
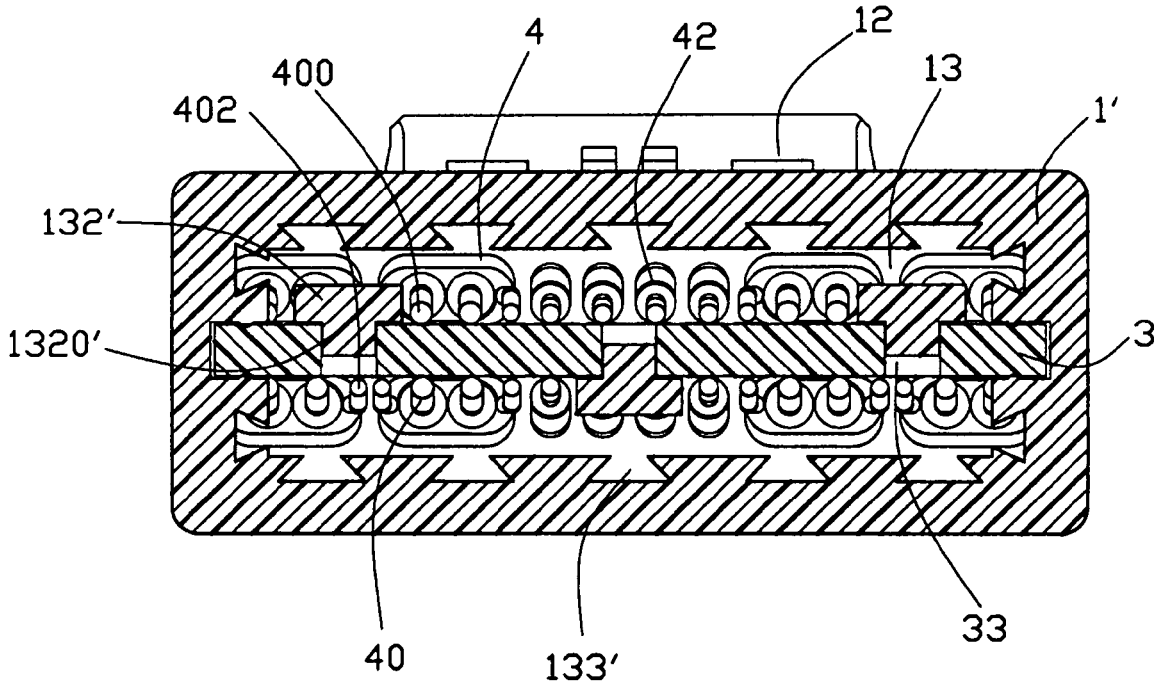
FIGS. 20-21 are cross-section views taken along lines 20-20 and 21-21 of FIG. 19.
Figure 21:
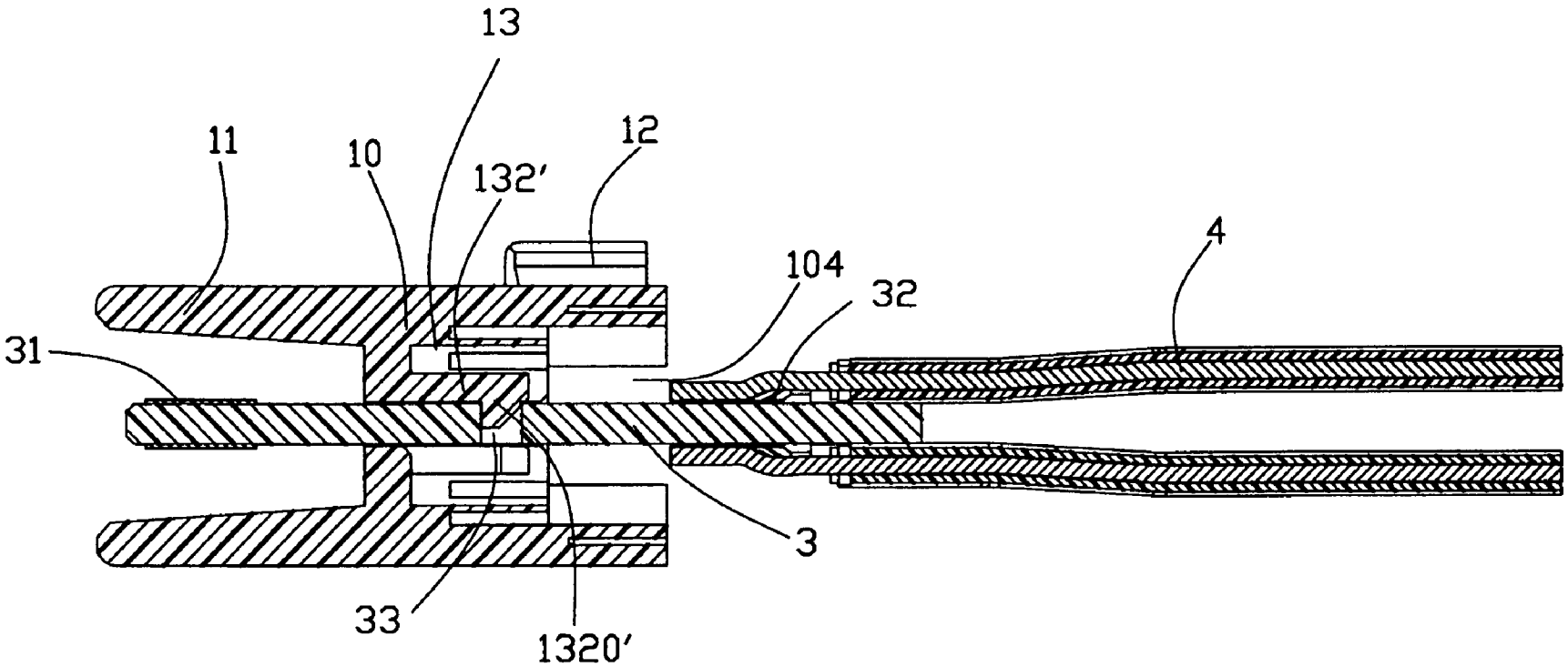
Figure 22:
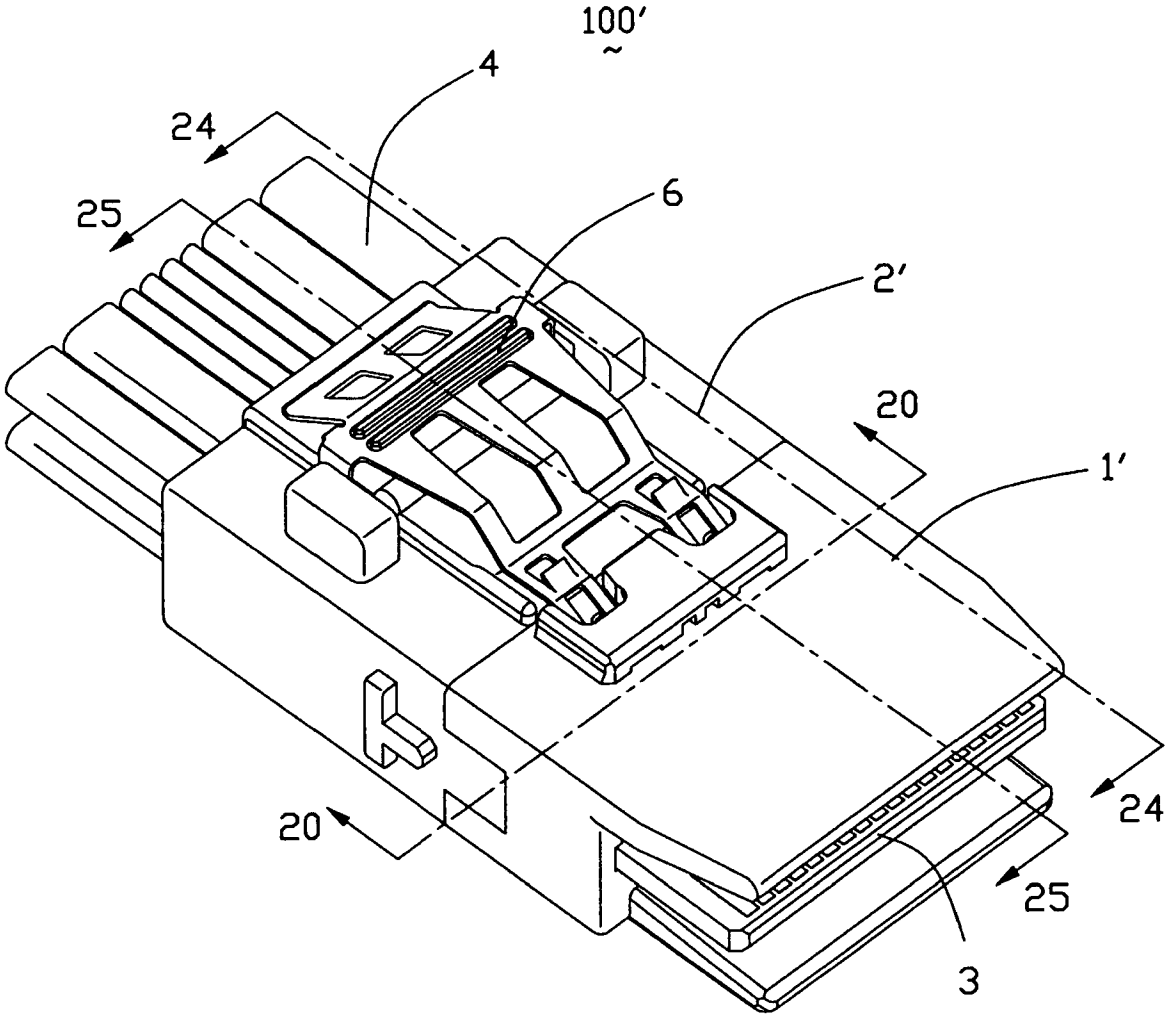
FIG. 22 is an assembled view of FIG. 17.
Figure 23:
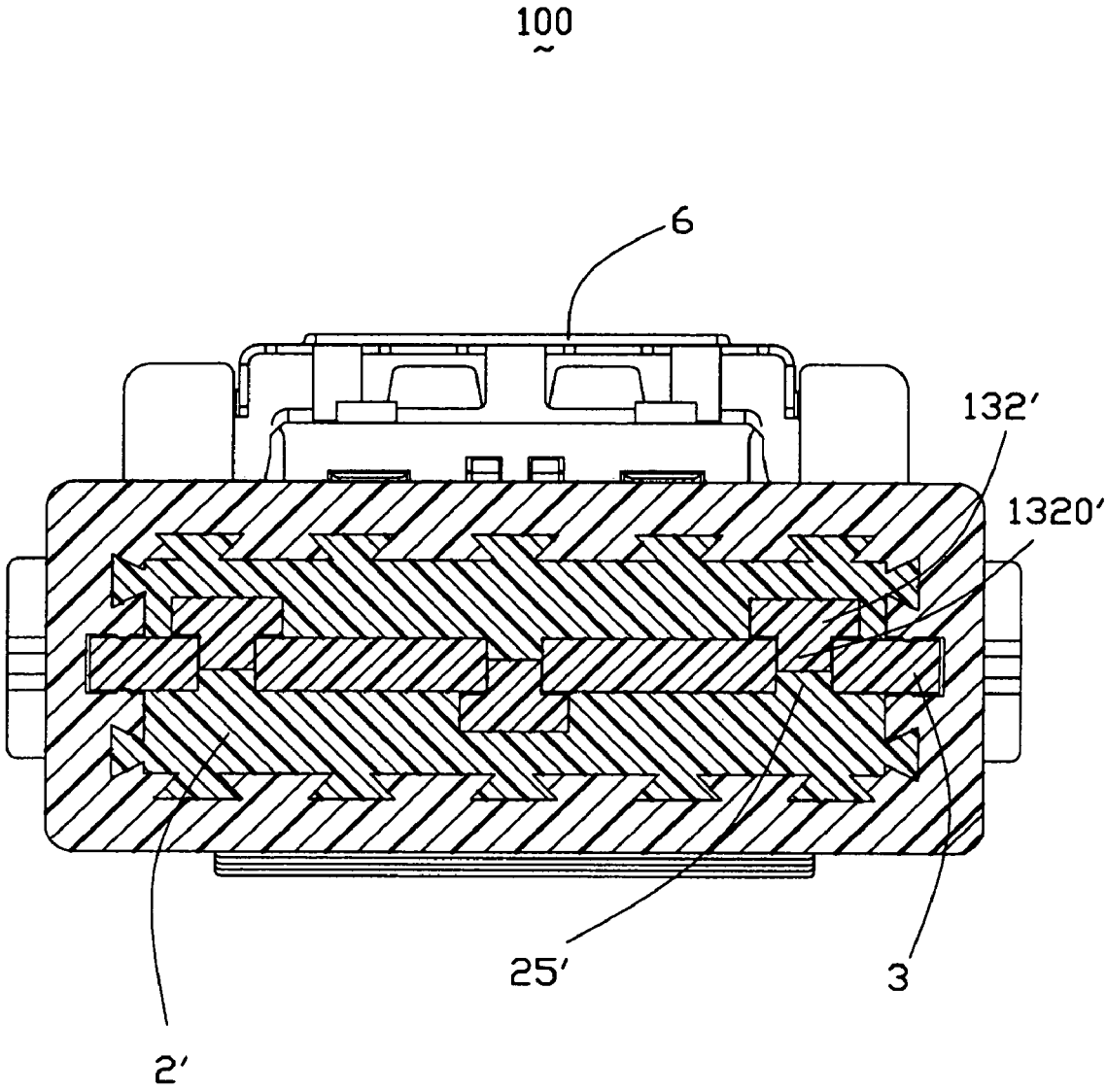
FIGS. 23-25 are cross-section views taken along lines 23-23 to 25-25 of FIG. 22.
Figure 24:
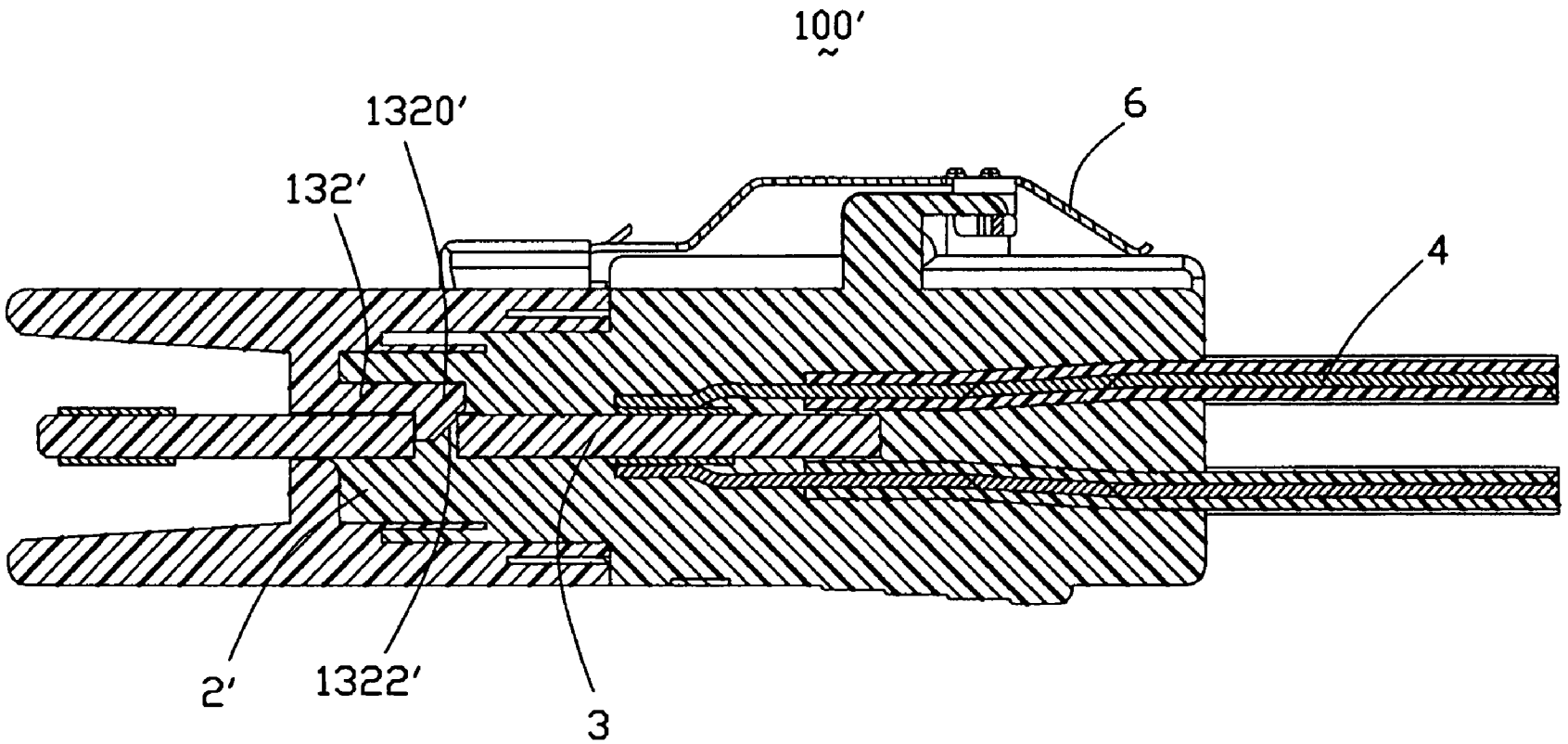
Figure 25:
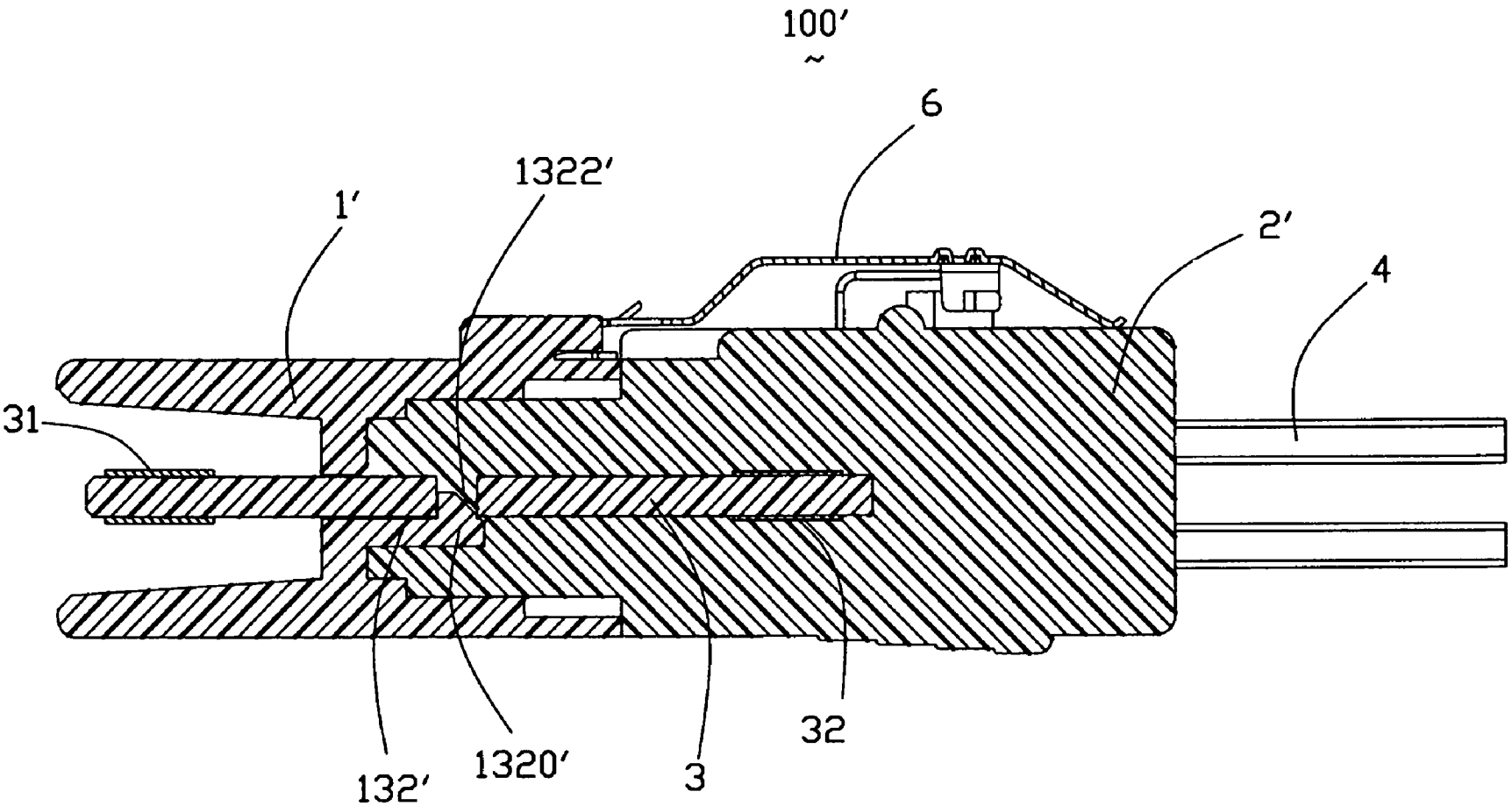
Figure 26:
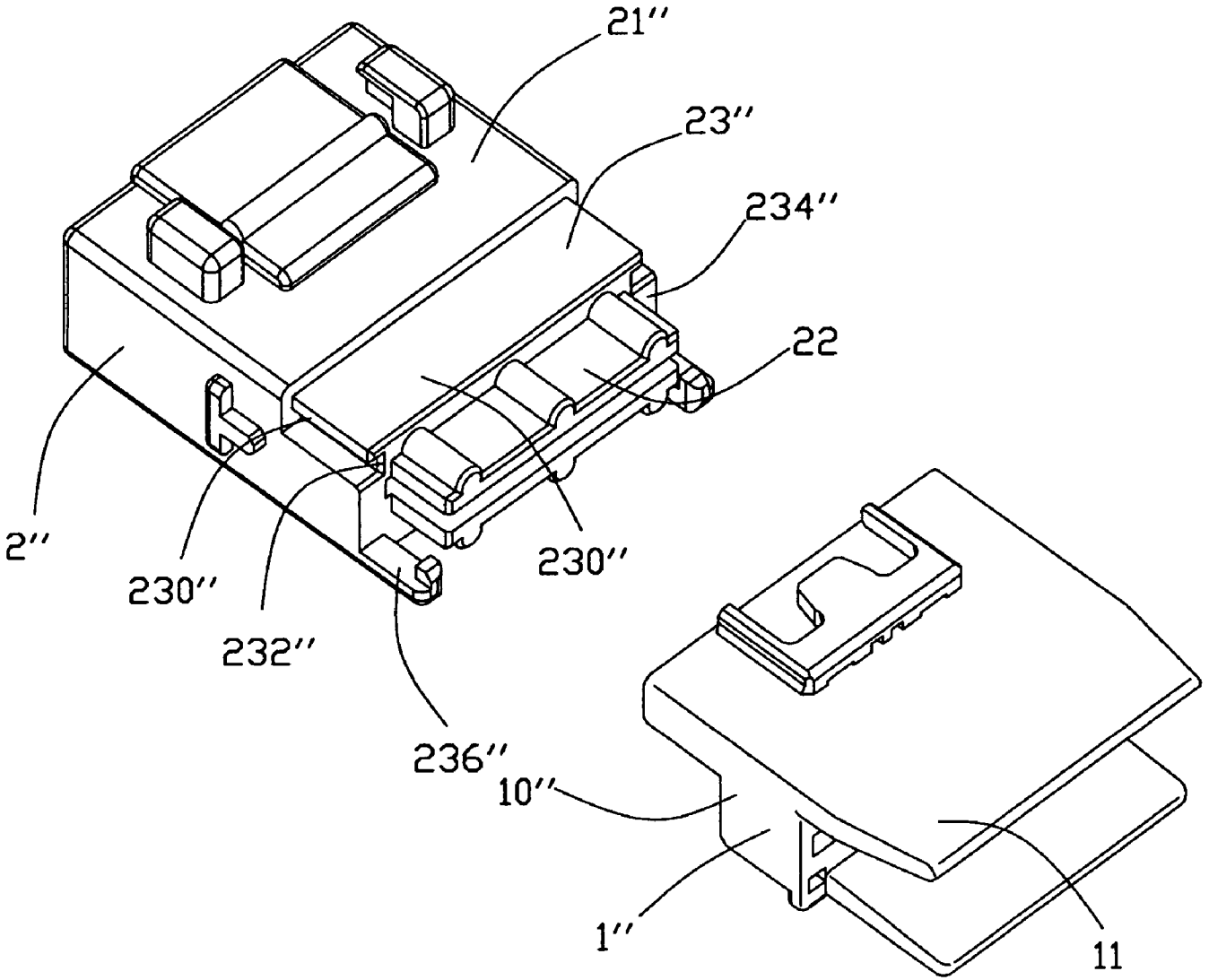
FIG. 26 is a perspective view of front and rear housing pieces of a cable connector assembly in accordance with the third embodiment of the present invention.
Figure 27:
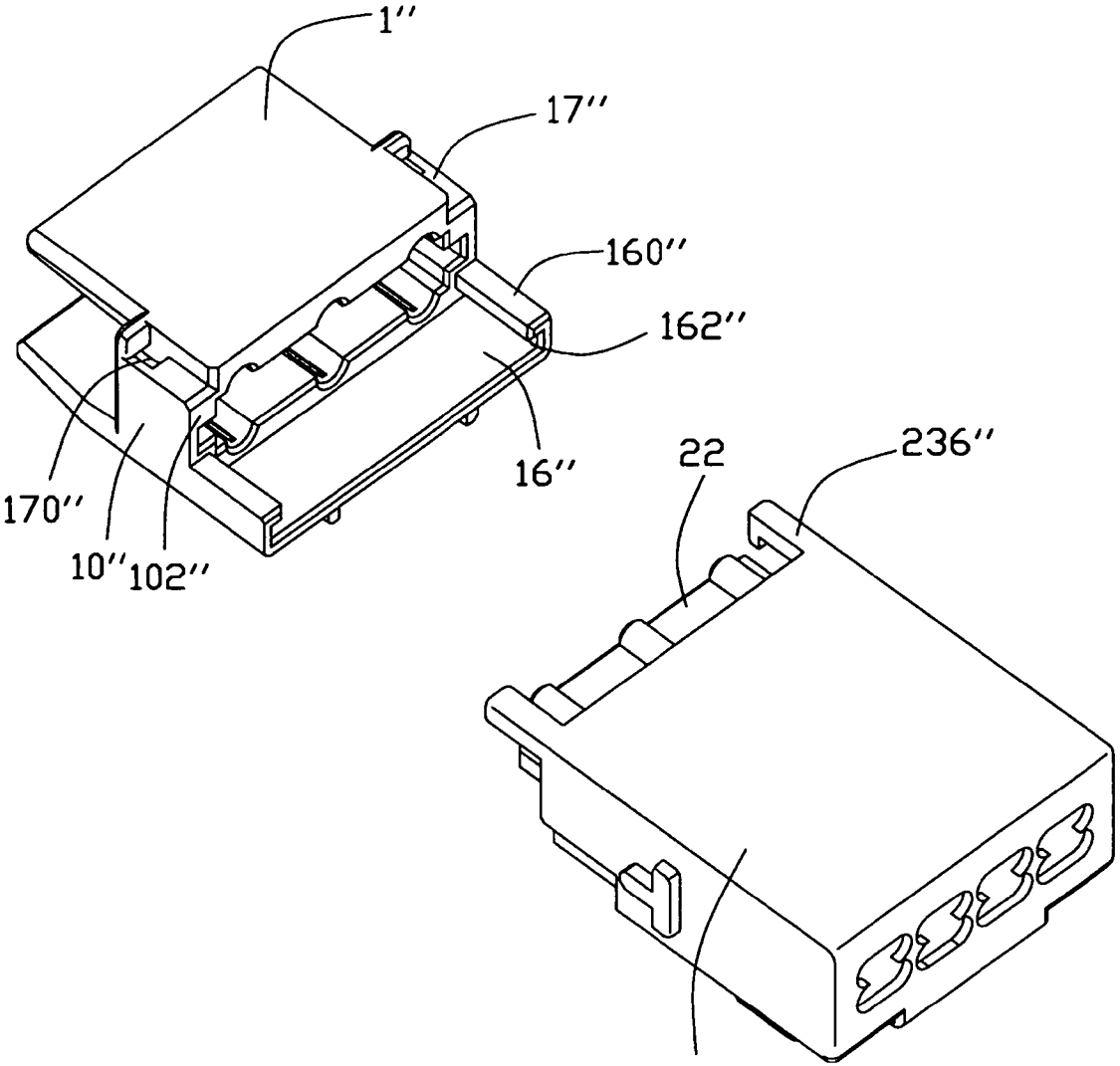
FIG. 27 is a view similar to FIG. 26 but viewed from another aspect.
Figure 28:
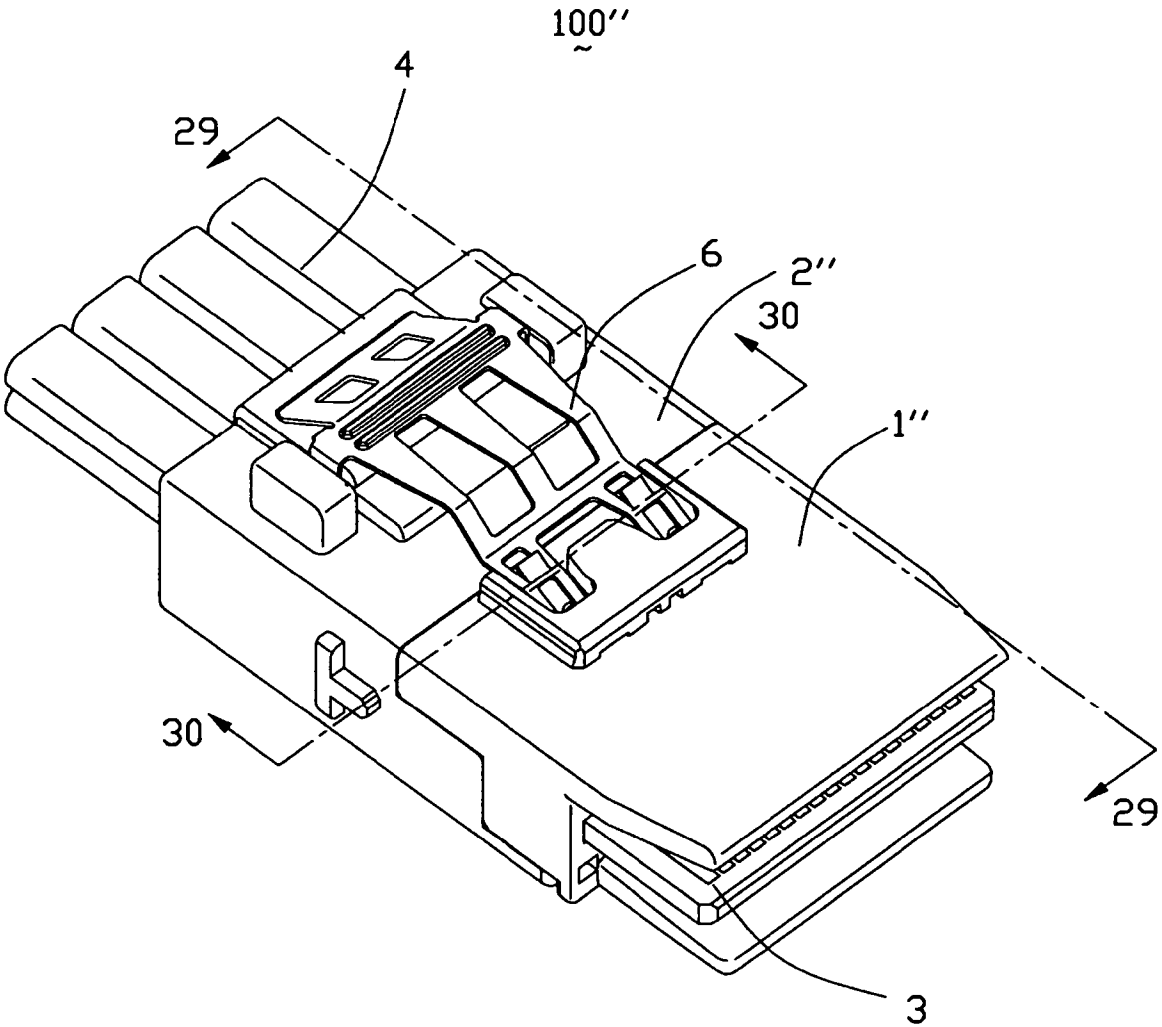
FIG. 28 is an assembled view of the cable connector assembly of the third embodiment.
Figure 29:
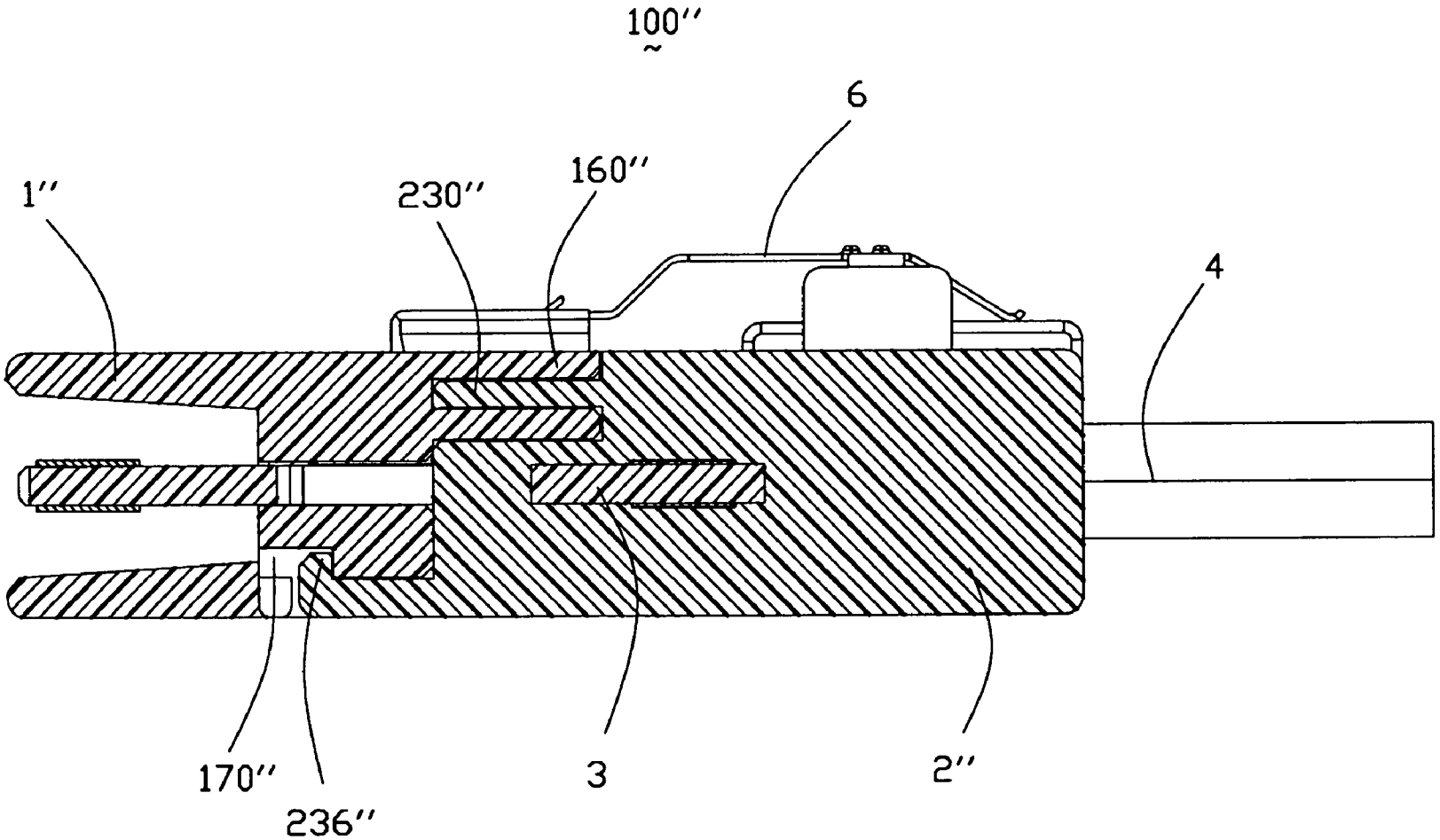
FIGS. 29-30 are cross-section views taken along lines 29-29 and 30-30 of FIG. 28.
Figure 30:
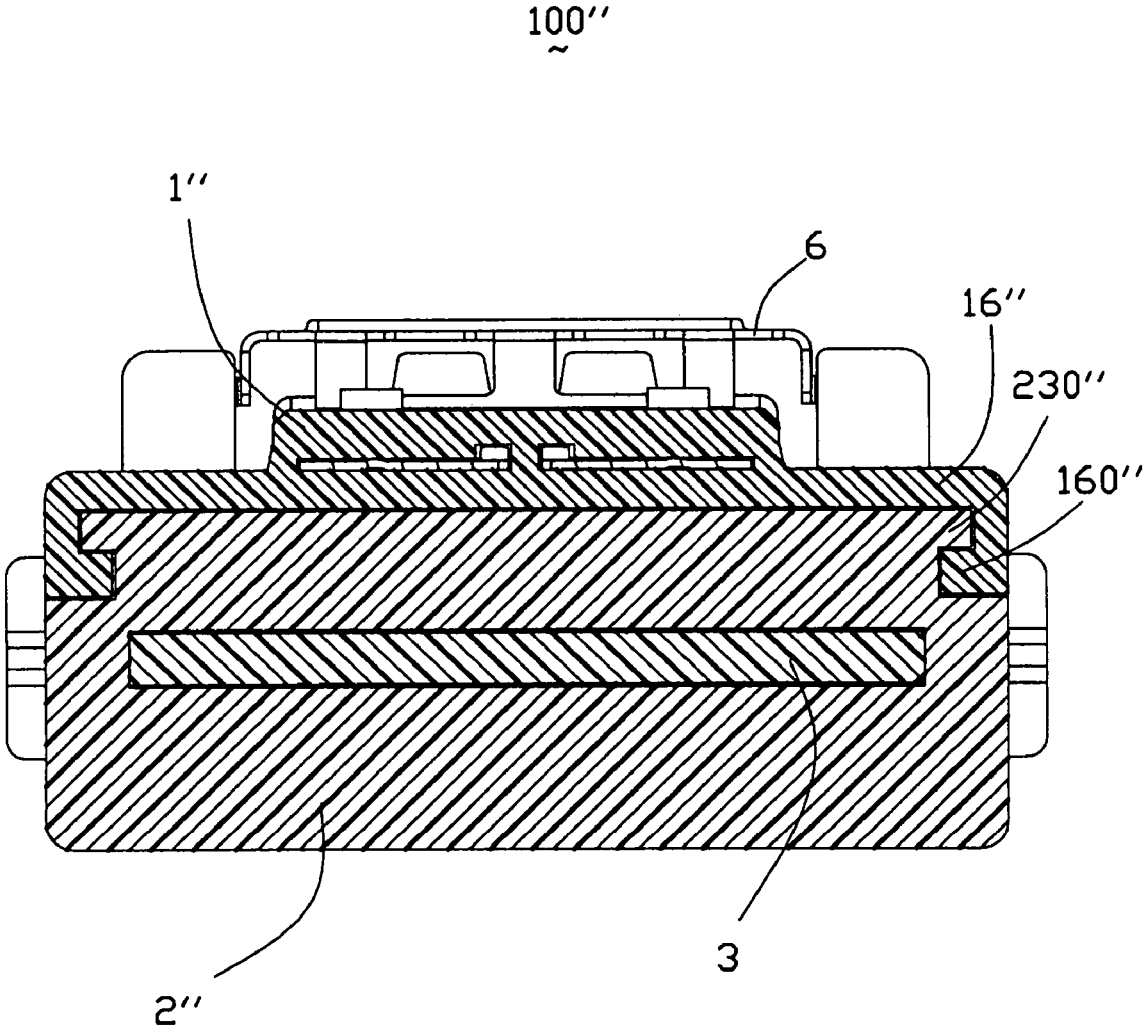
Figure 31:
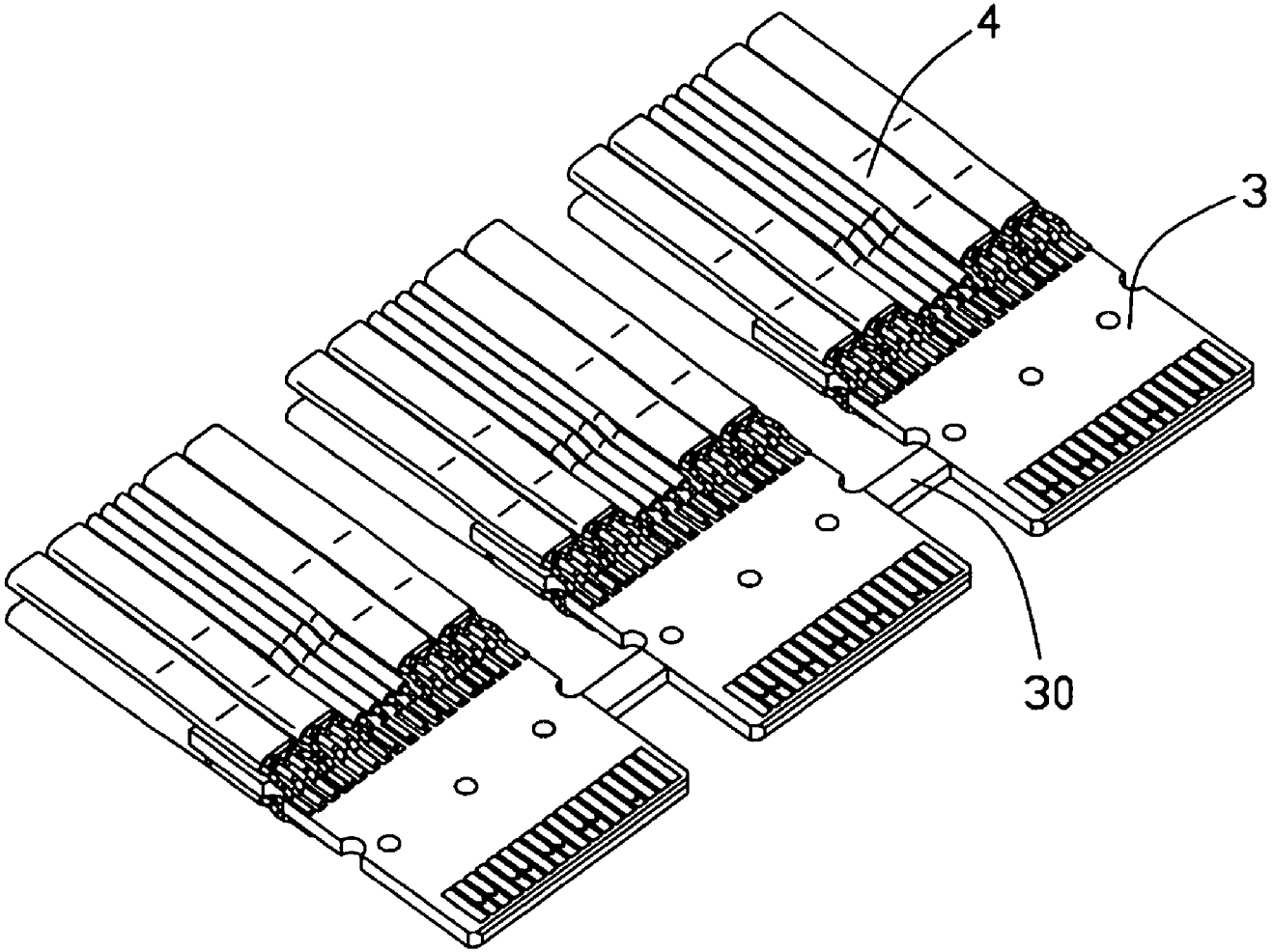
FIGS. 31 and 32 are partially assembled views of a cable connector assembly in accordance with the fourth embodiment of the present invention to illustrate a juxtaposed relationship.

Referring to FIGS. 17-18, different from the first embodiment in which the rear housing piece 2 is first molded with the printed circuit board 3 and the cables 4, then assembled to the front housing piece 1, the rear housing pieces 2' of the second embodiment is molded to the front housing piece 1', the junctions of the printed circuit board 3 and the cables 4. A pair of positioning noses 132' extends rearward from junctions between the bottom surface of the receiving slot 12 and the step surface 130 with top surfaces thereof coplanar with the bottom surface of the receiving slot 12 and locate at opposite sides of the step surface 130. A single positioning nose 132' extends rearward from junction between the top surface of the receiving slot 12 and the step surface 130 with bottom surface thereof coplanar with the top surface of the receiving slot 12 and locates at a middle of the step surface 130. Each positioning nose 132' forms a wedge 1320' with a slanting face 1322' facing to the rear face of the body portion 10'. A plurality of first swallow-tailed slots 1050' are formed in the pair of the longitudinal walls 15 opening toward the receiving space 14. A plurality of second swallow-tailed slots 133' recesses from inner periphery of the recess 13. The first swallowed-tailed slots 1050' and the second swallow-tailed slots 130' are alternatively arranged along the lateral direction for increasing retaining force with the rear housing piece 2'.

Referring to FIGS. 19-25, the cable connector assembly 100' has a different order to assemble the elements together. In assembly, the cables 4 are respectively soldered to the second conductive pads 32 of the printed circuit board 3. Next, the printed circuit board 3 with the cables 4 is inserted to the front housing piece 1'. The front end with the first conductive pads 31 protrudes through the receiving slot 12 to be exposed between the pair of tongue sections 110, 112. The wedges 1320' of the positioning noses 132' protrude into the through holes 33 of the printed circuit board 3, thus the middle of the printed circuit board 3 is sandwiched between the positioning noses 132'. Each wedge 1320' only occupies half space of corresponding through hole 33 of the printed circuit board 3. Then, the rear housing piece 2' is molded to the front housing piece 1', the printed circuit board 3 and the cables 4. Melted material of the rear housing piece 2' fills the recess 13, the receiving space 104, the cutouts 1030 of the lateral walls 103, and the rest space of the through holes 33 of the printed circuit board 3 to form protrusions 25' (FIG. 23) to hold the printed circuit board 3 reliably. The melted material of the rear housing piece 2' also fills the swallow-tailed slots 1050', 133' to enhance the engagement with the front housing piece 1'. After cool, the rear housing piece 2' forms a rear main portion 20 and a front engaging portion 21'. Therefore, through reliably engaging with the printed circuit board 3 commonly, the front and rear housing pieces 1', 2' engage with each other reliably. Then the locking member 6 is assembled to the front and rear housing pieces 1', 2' with the same assembly process and cooperation relationship described above and omitted here. In this embodiment, the positioning noses 132', the three through holes 33 of the printed circuit board 3 and the protrusions 25' of the rear housing piece 2' serve as engaging means to lock the printed circuit board 3 to the front housing piece 1'.

FIGS. 26-30 demonstrate another combination manner between the front and rear housing pieces 1", 2" to enhance reliable engagement between the front and rear housing pieces 1", 2". For illustration clearly, other structures same as the cable connector assembly 100 are omitted here and omitted in the figures. The front and rear housing pieces 1", 2" mainly latch with each other in this third embodiment. The guiding section 23" of the rear housing piece 2" forms a pair of latches 236" extending forwardly from a front face 234" thereof and located at opposite bottom sides thereof. The guiding section 23" defines a pair of guiding channels 232" respectively recessed inwardly from outer surfaces thereof and extending from the front face 234" to a rear face thereof, and thus, forming a pair of guiding edge 230'. Corresponding to the structure changes of the rear housing piece 2', the front housing piece 1' forms a pair of receiving cutouts 17" recessed upwardly from the bottom surface of the body portion 10' and respectively communicating with outer surfaces thereof. A latching opening 170" recesses upwardly from a top surface of corresponding cutout 17" and locates adjacent to the front surface 101. A flat supporting wall 16" extends rearward from the top surface of the body portion 10" and is formed with a pair of L-shape sidewalls 160", thus forming a pair of guiding passages 162" between each sidewall 160" and a bottom surface of the supporting wall 16".

In assembly, other same assembly process is omitted and the emphasis is the assembly of the new structures described above of the front and rear housing pieces 1", 2". The latches 236" slides along the cutouts 17" until the tip ends thereof received into the latching openings 170", at the same time, the guiding edges 230" of the rear housing piece 2" slide along the guiding passages 162" with the sidewalls 160" of the supporting wall 16" slide along the guiding channels 232". Thus, the first and the second housing pieces 1", 2" latch with each other. Of course, in other embodiment, the latches 236" may be disposed to the front housing piece 1". In this embodiment, the latches 236" of the rear housing piece 2" and the latching openings 170" of the front housing piece 1" serve as retaining means to combine the front and the rear housing pieces 1", 2" together.

Figure 32:
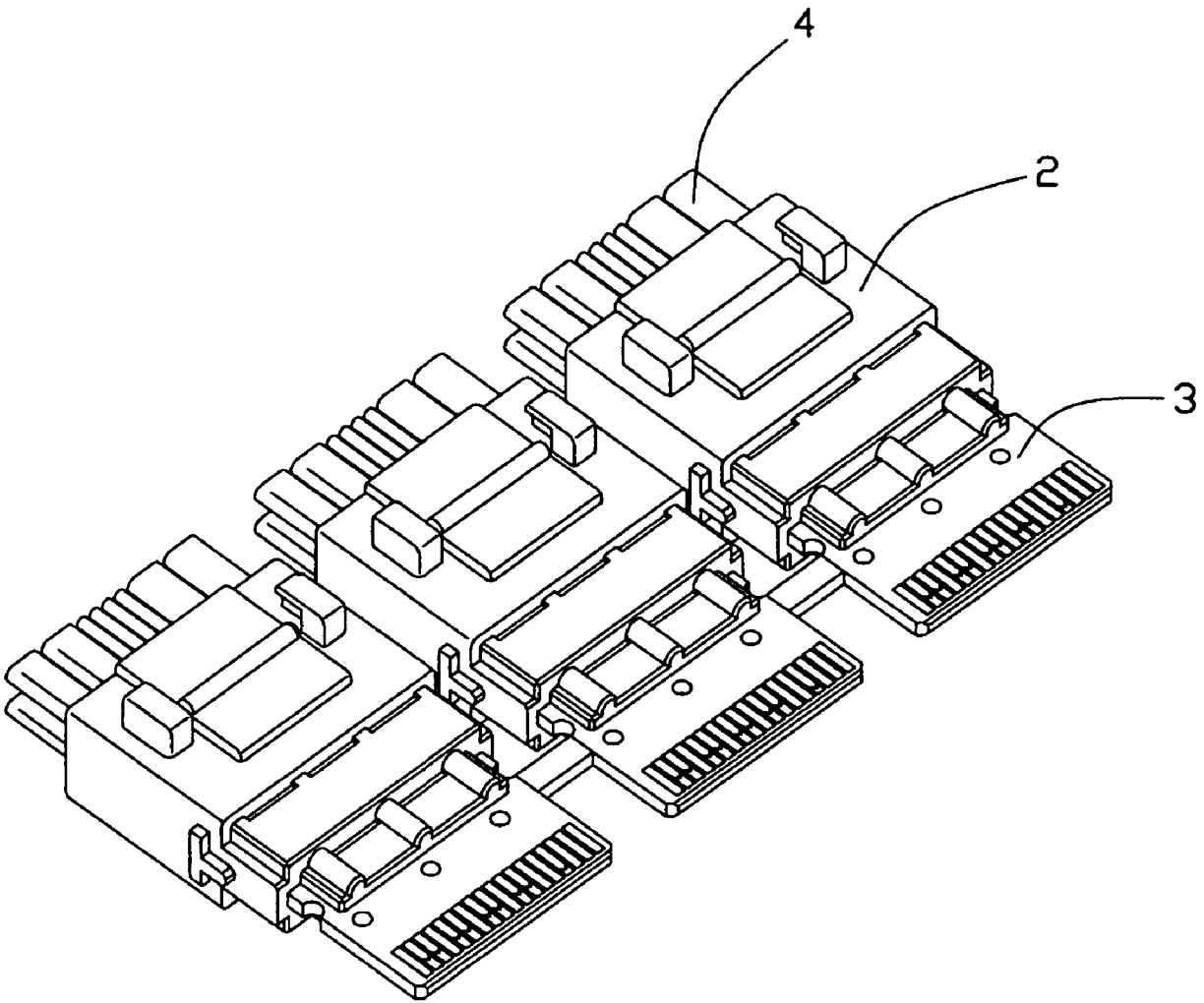

To comply different applying requirements, the cable connector assembly 100, 100' and 100" may be juxtaposed arranged. Now only a partially assembled cable connector assembly 100 is taken as an example. Referring to FIGS. 32-33, three printed circuit boards 3 are connected to one another through a bridge section 30 integrally formed with the printed circuit boards 3. Then three rear housing pieces 2 are respectively molded to the printed circuit boards 3 and the cables 4. Of course, the amount of the cable connect assemblies 100 and means which can be adopted to connect the cable connector assemblies 100 is not limited to the manner described above, and the cable connector assemblies 100 also can be stacked.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly for mating with a complementary connector, comprising:

a rear housing piece defining a front through slot and a rear receiving passage communicating with the through slot;

a cable comprising a plurality of conductors and extending through the receiving passage of the rear housing piece;

a printed circuit board assembled to the rear housing piece and comprising a front portion formed with a plurality of first conductive pads and an opposite rear portion formed with a plurality of second conductive pads electrically connecting with the conductors of the cable, the rear portion being received in the through slot of the rear housing piece and the front portion extending outside the rear housing piece;

a front housing piece assembled with the rear housing piece and enclosing part of the printed circuit board, the front housing piece comprising a body portion defining a receiving slot therethrough to permit the front portion of the printed circuit board protruding through for electrically connecting with the complementary connector and at least one tongue section extending forwardly from a front surface of the body portion and spaced from the printed circuit board and parallel to the printed circuit board;

retaining means assembling the rear housing piece to the front housing piece reliably; and engaging means locking the printed circuit board to one of the front housing piece and the rear housing piece reliably, and a locking member assembled to one of the front housing piece and the rear housing piece.

2. The cable connector assembly as claimed in claim 1, wherein the retaining means comprises a latch extending from one of the front housing piece and the rear housing piece and a latch opening defined by one of the rear housing and the front housing piece, and wherein the latch latches into the latch opening to retain the rear housing piece to the front housing piece.

3. The cable connector assembly as claimed in claim 1, wherein the engaging means comprises at least one pair of holes formed in the printed circuit board and at least one pair of bolts respectively protruding into the holes, and wherein one of the front housing piece and the rear housing piece defines a pair of positioning cavities aligning with the holes of the printed circuit board to receive the bolts, the positioning cavities open toward different directions.

4. The cable connector assembly as claimed in claim 1, wherein the locking member comprises a retaining portion assembled to one of the front housing piece and the rear housing piece and substantially immovable relative to said one of the front housing piece and the rear housing piece, a pressing portion assembled to one of the front housing piece and the rear housing piece, and a locking portion moveable relative to the retaining portion for locking with the complementary connector.

5. The cable connector assembly as claimed in claim 1, the locking member further comprises a supporting portion extending rearward from the pressing portion to pressing on one of the front housing piece and the rear housing piece, the supporting portion and the retaining portion together forms a pair of fulcrums for the pressing portion.

6. The cable connector assembly as claimed in claim 1, wherein the locking member further comprises an intermediate portion connecting with the pressing portion and the locking portion for increasing flexibility.

7. The cable connector assembly as claimed in claim 1, wherein the pressing portion comprises a body section for operating and a pair of side beams extending vertically from the body section, and wherein one of the front housing piece and the rear housing piece forms a pair of ear sections to respectively engage with the side beams of the locking member.

8. The cable connector assembly as claimed in claim 1, wherein one of the front housing piece and the rear housing piece defines a cutout extending along a front-back direction, and the locking member forms a spring tab not only moveable relative to the retaining portion but also restrictively moveable in said cutout in a vertical direction perpendicular to said front-back direction, so that the locking member is able to be restrictively up and down moveable relative to the front housing piece and the rear housing piece fro engagement with or disengagement from the complementary connector.

9. The cable connector assembly as claimed in claim 1, wherein engaging means comprises at least one bole funned between the first and second conductive pads of the printed circuit board and at least one bolt assembled to one of the front housing piece and the rear housing piece and protruding into the at least one hole of the printed circuit board to retain the printed circuit board to one of the front housing piece and the rear housing piece.

10. The cable connector assembly as claimed in claim 6, wherein the front housing piece defines a positioning cavity recessed from one of opposite of upper and lower surfaces of the receiving slot, and wherein the positioning cavity aligns with the bole of the printed circuit board to receive the bolt.

11. The cable connector assembly as claimed in claim 7, wherein front housing piece defines a depression aligning and communicating with the positioning cavity to receive a head portion of the bolt.

12. The cable connector assembly as claimed in claim 1, wherein the cable connector assembly comprises a holding portion formed on one of front housing piece and the rear housing piece, and a recess in one of the rear housing piece and the front housing piece to receive the holding portion.

13. The cable connector assembly as claimed in claim 12, wherein the front housing piece and rear housing piece are retained together by means of one of spreading glue to the holding portion and the recess and overmolding the holding portion to fill the recess.

14. The cable connector assembly as claimed in claim 12, wherein the retaining means comprises at least one column formed with the holding portion, and at least one receiving opening recessed from the recess, and wherein the column is received in the receiving opening.

15. The cable connector assembly as claimed in claim 14, wherein engaging means comprises a hole formed in the printed circuit board and a bolt protruding into the hole, and wherein the bolt locates in front of the receiving opening of the front housing piece.

16. The cable connector assembly as claimed in claim 12, wherein engaging means comprises at least one through hole formed in the printed circuit board and a wedge formed in the recess of one of the front housing piece and the rear housing piece, and wherein the wedge protrudes into the through hole of the printed circuit board.

17. The cable connector assembly as claimed in claim 16, wherein the wedge occupies part space of the through hole, and wherein one of the rear housing piece and the front housing piece forms a protrusion occupying other space of the through hole.

18. The cable connector assembly as claimed in claim 16, wherein one of the front housing piece and the rear housing piece forms a positioning nose extending into the recess, and wherein the wedge is formed on a free end of the positioning nose.

19. The cable connector assembly as claimed in claim 16, wherein one of the front housing piece and the rear housing piece forms a pair of positioning noses extending from opposite sides of the receiving slot, and wherein the wedge is formed with one of the pair of positioning noses and the printed circuit board is sandwiched between the pair of positioning noses.

20. A cable connector assembly comprising:

a front housing defining a pair of tongue sections with a receiving cavity therebetween;

a rear housing assembled to a rear portion of the front housing, a printed circuit board defining a front portion extending into the front housing and a rear portion extending into the rear housing, said printed circuit board defining at least one hole;

a plurality of wires having front sections connected to a rear portion of the printed circuit board and located in the rear housing; and an engaging device associated with the front housing and projecting into the hole to lock the printed circuit board in position; and wherein said wires and the printed circuit board are commonly integrally formed with the rear housing under a condition that the rear housing fully circumscribes the wires and the printed circuit board via an overmolding process, and at least one operable locking member is disposed on an exterior of the rear housing; and wherein there are a plurality of sets of said front housing and said rear housing with therein the corresponding printed circuit boards assembled together in a side-by-side manner via bridge sections each linked between every adjacent two printed circuit boards.

21. The cable connector assembly as claimed in claim 20, wherein said engaging device is integrally formed with the front housing and unexposed to an exterior.

22. A cable connector assembly comprising:

a front housing defining a pair of tongue sections with a receiving cavity therebetween;

a rear housing assembled to a rear portion of the front housing, a printed circuit board defining a front portion extending into the front housing and a rear portion extending into the rear housing, said printed circuit board defining at least one hole;

a plurality of wires having front sections connected to a rear portion of the printed circuit board and located in the rear housing; and an engaging device associated with the front housing and projecting into the hole to lock the printed circuit board in position; wherein there are a plurality of sets of said front housing and said rear housing with therein the corresponding printed circuit boards assembled together in a side-by-side manner via bridge sections each linked between every adjacent two printed circuit boards.

* * * * *